US010906693B2

(12) United States Patent
Morimoto

(10) Patent No.: US 10,906,693 B2
(45) Date of Patent: Feb. 2, 2021

(54) CORRUGATED FIBERBOARD BOX

(71) Applicant: Rakuten, Inc., Tokyo (JP)

(72) Inventor: Masanori Morimoto, Tokyo (JP)

(73) Assignee: Rakuten, Inc., Tokyo (JP)

( * ) Notice: Subject to any disclaimer, the term of this patent is extended or adjusted under 35 U.S.C. 154(b) by 142 days.

(21) Appl. No.: 15/318,242

(22) PCT Filed: Jun. 13, 2014

(86) PCT No.: PCT/JP2014/065737
§ 371 (c)(1),
(2) Date: Dec. 12, 2016

(87) PCT Pub. No.: WO2015/189984
PCT Pub. Date: Dec. 17, 2015

(65) Prior Publication Data
US 2017/0121052 A1 May 4, 2017

(51) Int. Cl.
*B65D 5/70* (2006.01)
*B65D 5/54* (2006.01)
(Continued)

(52) U.S. Cl.
CPC ..... *B65D 5/54* (2013.01); *B65D 5/0236* (2013.01); *B65D 5/4266* (2013.01); *B65D 5/441* (2013.01); *B65D 5/541* (2013.01); *B65D 5/542* (2013.01)

(58) Field of Classification Search
CPC ..... B65D 5/54; B65D 5/5405; B65D 5/545; B65D 5/548; B65D 5/705; B65D 5/70;
(Continued)

(56) References Cited

U.S. PATENT DOCUMENTS 2,233,602 A * 3/1941 Greeley ..... B65D 5/705 222/541.9
2,706,076 A * 4/1955 Guyer ..... B65D 5/5445 229/198.1
(Continued)

FOREIGN PATENT DOCUMENTS

GB 2358855 A * 8/2001 ..... B65D 5/542
JP 2-63323 U 5/1990
(Continued)

OTHER PUBLICATIONS

JP2007008529Translation.*
(Continued)

*Primary Examiner* — Nathan J Newhouse
*Assistant Examiner* — Nina K Attel
(74) *Attorney, Agent, or Firm* — Sughrue Mion, PLLC

(57) ABSTRACT

The pull tab portion is formed as an area surrounded by four solid or broken line-formed incisions. The four incisions include a first incision which is formed as a boundary line of the push-in portion, a pair of second incisions each of which is continuous with the first incision and which are spaced apart from each other in the width direction of the adhesive tape, and a third incision which is continuous with each of the pair of second incisions and functions as a folding line. When those ends of the pair of second incisions which are each located opposite to the push-in portion are called tape-side incision ends, the distance between the two tape-side incision ends in the width direction of the adhesive tape is set greater than the width of the adhesive tape.

17 Claims, 15 Drawing Sheets

(51) Int. Cl.

| | |
|---|---|
| ***B65D 5/44*** | (2006.01) |
| ***B65D 5/02*** | (2006.01) |
| ***B65D 5/42*** | (2006.01) |

(58) Field of Classification Search

CPC .. B65D 5/0236; B65D 5/2066; B65D 5/4266; B65D 5/701; B65D 5/703; B65D 5/706; B65D 5/708; B65D 5/6611

USPC ..... 229/237, 240–244, 125.39, 238, 123.1, 229/123.2, 200, 206–208, 102

See application file for complete search history.

(56) References Cited

U.S. PATENT DOCUMENTS

| | | | | | |
|---|---|---|---|---|---|
| 3,019,944 | A * | 2/1962 | Nelson | B65D 5/16 | 221/302 |
| 3,302,857 | A * | 2/1967 | Martin | B65D 5/0236 | 229/238 |
| 5,464,151 | A * | 11/1995 | Parker | B65D 77/32 | 229/206 |
| 5,582,571 | A * | 12/1996 | Simpson | B26F 1/18 | 493/355 |
| 2007/0063008 | A1* | 3/2007 | El-Afandi | B65D 5/0236 | 229/125.39 |

FOREIGN PATENT DOCUMENTS

| | | | | |
|---|---|---|---|---|
| JP | 2646410 | B2 | | 8/1997 |
| JP | 3057683 | U | | 3/1999 |
| JP | 2001-139024 | A | | 5/2001 |
| JP | 2007-8529 | A | | 1/2007 |
| JP | 2009-91003 | A | | 4/2009 |
| JP | 2009091003 | A | * | 4/2009 |
| JP | 3164053 | U | | 11/2010 |

OTHER PUBLICATIONS

JP2007008529Translation2 (Year: 2007).*

International Search Report for PCT/JP2014/065737 dated Aug. 12, 2014 [PCT/ISA/210].

* cited by examiner

CORRUGATED FIBERBOARD BOX

CROSS REFERENCE TO RELATED APPLICATIONS

This application is a National Stage of International Application No. PCT/JP2014/065737, filed on Jun. 13, 2014, the contents of all of which are incorporated herein by reference in their entirety.

TECHNICAL FIELD

The present invention relates to a technical field concerning a corrugated fiberboard box which is sealed by sticking an adhesive tape to an area ranging from a line-of-juncture part of a pair of outer lap portions to a part each of a pair of side surface portions and which is provided with a pull tab portion that is drawn out for peeling the adhesive tape.

CITATION LIST

Patent Literature

Patent Literature 1: Japanese Utility Model Laid-open No. 1990-63323

BACKGROUND ART

There are corrugated fiberboard boxes in which various articles are accommodated for transporting the articles. The corrugated fiberboard boxes include those which each have, for example, a bottom surface portion, four side surface portions each continuous with an outer peripheral edge of the bottom surface portion, a pair of inner lap portions continuous with respective one-end parts of two of the side surface portions, and a pair of outer lap portions continuous with respective one-end parts of the other two of the side surface portions, and which are each sealed by sticking an adhesive tape to an area ranging from a line-of-juncture part of the pair of outer lap portions to a part each of two of first side surface portions.

Some of such corrugated fiberboard boxes as above-mentioned are each provided with a pull tab portion for easily peeling the stuck adhesive tape at the time of package opening (see, for example, Patent Literature 1).

In the corrugated fiberboard box as described in Patent Literature 1, the pair of opposed side surface portions (end surface portions) are each provided with a pull tab portion and a push-in portion which are rectangular in shape and are provided continuously on the upper and lower sides. Each of the pull tab portion and the push-in portion is formed as an area surrounded by four solid or broken line-formed incisions. The incision constituting the lower edge of the pull tab portion serves also as the incision constituting the upper edge of the push-in portion. The pull tab portion has its upper edge formed as a folding line, and the push-in portion has its lower edge formed as a folding line.

The adhesive tape is stuck to an area ranging from a line-of-juncture part of a pair of outer lap portions to an upper end portion each of a pair of side surface portions. The widths of the pull tab portion and the push-in portion in the left-right direction are set smaller than the width of the adhesive tape, and both end portions in the longitudinal direction of the adhesive tape are each stuck in the state of lying across the pull tab portion while externally covering the incisions each forming both left and right side edges of the pull tab portion.

At the time of package opening, first, the push-in portion is bent with its lower edge as a folding line and pushed inward to form an opening. Next, a finger is inserted into the opening, then the pull tab portion is bent with its upper edge as a folding line and is drawn outward. When the pull tab portion is drawn outward, an end portion in the longitudinal direction of the adhesive tape is peeled from the side surface portion together with the pull tab portion, and, subsequently, the drawn-out pull tab portion is pulled along the adhesive tape, whereby the adhesive tape is peeled together with the face liner or a surface part of the face liner.

In the corrugated fiberboard box wherein a pull tab portion and a push-in portion are thus provided in a side surface portion or portions, package opening is conducted as follows. The push-in portion is pushed in to form an opening, a finger is inserted into the opening, the pull tab portion is drawn out, and the thus drawn-out pull tab portion is pulled in a predetermined direction, whereby the adhesive tape is peeled. Accordingly, the operation of peeling the stuck adhesive tape can be carried out easily.

SUMMARY OF INVENTION

Technical Problem

In the corrugated fiberboard box provided with the pull tab portion and the push-in portion, the operation of peeling the adhesive tape at the time of package opening can be performed easily, as above-mentioned. The adhesive tape is stuck to the corrugated fiberboard box by a tape sticking apparatus in some cases, and is stuck by a manual operation in other cases. Particularly in the case where the adhesive tape is stuck by a manual operation, an end portion in the longitudinal direction of the adhesive tape may be stuck to the side surface portion at a position on the upper side of the pull tab portion.

In this case, in drawing out the pull tab portion and performing the operation of peeling the adhesive tape, the drawing-out of the pull tab portion needs only a small force and can be carried out easily, since the adhesive tape is not stuck in the state of lying across the pull tab portion. However, when the pull tab portion thus drawn out is pulled upward and the face liner or its surface part is peeled, the peeled face liner would reach only one end edge in the longitudinal direction of the adhesive tape.

Therefore, the adhesion of the adhesive tape may act as a resistance against the force exerted for peeling the adhesive tape, so that it may be impossible to peel the adhesive tape easily. Especially, when the pull tab portion is pulled upward, the thin face liner or its surface part is peeled, so that when the thus peeled face liner reaches one end edge in the longitudinal direction of the adhesive tape, the face liner may even be torn off in the manner of being overwhelmed by the adhesion of the adhesive tape.

In view of the foregoing, it is an object of the present invention to surmount the above-mentioned problems and enable easy peeling of an adhesive tape regardless of the position where the adhesive tape is stuck.

Solution to Problems

Firstly, a corrugated fiberboard box according to the present invention is a corrugated fiberboard box which includes a pair of first side surface portions, a pair of second side surface portions alternately continuous with the pair of first side surface portions, a pair of inner lap portions continuous with respective one-end portions of the pair of first side surface portions, and a pair of outer lap portions continuous with respective one-end portions of the pair of second side surface portions, and which is sealed by sticking an adhesive tape to an area ranging from a line-of-juncture part of the pair of outer lap portions to a part each of the pair of first side surface portions, wherein at least one of the pair of first side surface portions is provided with a push-in portion which is pushed inward during package opening, and a pull tab portion which is located on the adhesive tape side of the push-in portion and is drawn outward during package opening, the push-in portion and the pull tab portion being continuous with each other; the pull tab portion is formed as an area surrounded by four solid or broken line-formed incisions; the four incisions include a first incision formed as a boundary line of the push-in portion, a pair of second incisions each of which is continuous with the first incision and which are spaced apart from each other in a width direction of the adhesive tape, and a third incision which is continuous with each of the pair of second incisions and functions as a folding line; and when those ends of the pair of second incisions which are each located opposite to the push-in portion are called tape-side incision ends, the distance between the two tape-side incision ends in the width direction of the adhesive tape is set greater than a width of the adhesive tape.

This ensures that, of end portions in the longitudinal direction of the adhesive tape, at least parts of both ends in the width direction are located on inner sides as compared with the tape-side incision ends of the pair of second incisions.

Secondly, in the corrugated fiberboard box according to the present invention as above, it is desirable that the pair of second incisions are formed in a state of being parallel to side edges on both sides in the width direction of the adhesive tape.

This configuration ensures that the distance between the second incisions is greater than the width of the adhesive tape, at any position in the longitudinal direction of the adhesive tape.

Thirdly, in the corrugated fiberboard box according to the present invention as above, it is desirable that the first incision is formed in a form of a solid line penetrating the first side surface portion.

This configuration ensures that the force required for drawing out the pull tab portion during package opening is reduced, and the force necessary for pushing in the push-in portion during package opening is reduced.

Fourthly, in the corrugated fiberboard box according to the present invention as above, it is desirable that the first side surface portion is formed with a pair of auxiliary incisions at positions on an opposite side of the pull tab portion from the push-in portion, the auxiliary incision has a cut formed only on a face side of the first side surface portion, the pair of auxiliary incisions are located apart from each other in the width direction of the adhesive tape, and the distance between ends of the auxiliary incisions on the pull tab portion side is set greater than the width of the adhesive tape.

This configuration ensures that during when the adhesive tape is gradually peeled off by pulling the pull tab portion, a part between the auxiliary incisions is gradually peeled off while ruptured parts of the first side surface portion are being guided by the auxiliary incisions.

Fifthly, in the corrugated fiberboard box according to the present invention as above, it is desirable that the distance between the pair of auxiliary incisions is decreased in going away from the pull tab portion.

This configuration ensures that during when the adhesive tape is gradually peeled off by pulling the pull tab portion, a part between the auxiliary incisions is gradually peeled off while ruptured parts of the first side surface portion are being guided by the auxiliary incisions, so that the width of the part peeled off is gradually reduced.

Sixthly, in the corrugated fiberboard box according to the present invention as above, it is desirable that the third incision is formed in a form of a broken line having a plurality of cuts in each of a face liner and a back liner, and a length of the cut in the face liner of the third incision is set shorter than a length of the cut in the back liner of the third incision.

This configuration ensures that the pull tab portion is hard to displace in the direction of pushing inward and easy to displace in the direction of drawing outward.

Seventhly, in the corrugated fiberboard box according to the present invention as above, it is desirable that the second incision is formed in a form of a broken line having a plurality of cuts in each of a face liner and a back liner, and a length of the cut in the face liner of the second incision is set shorter than a length of the cut in the back liner of the second incision.

This configuration ensures that the pull tab portion is hard to displace in the direction of pushing inward and easy to displace in the direction of drawing outward.

Eighthly, in the corrugated fiberboard box according to the present invention as above, it is desirable that the pair of second incisions are each formed in a state of having a cut in each of a face liner and a back liner, and the distance between the pair of second incisions in the face liner is set greater than the distance between the pair of second incisions in the back liner.

This ensures that parts relevant to the difference between the distance on the face liner side of the pull tab portion and the distance on the back liner side act as endurance against forces which may be exerted on the pull tab portion from outside, so that the pull tab portion becomes harder to push in and easier to draw out.

Ninthly, in the corrugated fiberboard box according to the present invention as above, it is desirable that the area of the push-in portion is set smaller than the area of the pull tab portion.

This configuration ensures that the push-in portion is harder to push in than the pull tab portion.

Tenthly, in the corrugated fiberboard box according to the present invention as above, it is desirable that the push-in portion is formed in a tetragonal shape, and the end edge of the push-in portion which is opposite to the pull tab portion is set to coincide with one end edge of the first side surface portion.

This configuration ensures that the end edge of the push-in portion which is opposite to the pull tab portion coincides with a bent part of the first side surface portion.

Eleventhly, in the corrugated fiberboard box according to the present invention as above, it is desirable that each of the pull tab portion and the push-in portion is formed in a tetragonal shape, the push-in portion is formed as an area surrounded by at least three solid or broken line-formed incisions, the three incisions include a fourth incision formed as a boundary line of the pull tab portion, and a pair of fifth incisions each of which is continuous with the fourth incision and which are spaced apart from each other in the width direction of the adhesive tape, each of the second incision and the fifth incision is formed in a form of a broken line, and the length of each cut of the second incision is set shorter than a length of each cut of the fifth incision.

This configuration ensures that the pull tab portion is made hard to push in whereas the push-in portion is made easy to push in.

Advantageous Effect of Invention

According to the present invention, even in the case where an end portion in the longitudinal direction of the adhesive tape is not stuck to the pull tab portion, the adhesive tape is peeled together with a part of the first side surface portion, so that the adhesive tape can be easily peeled regardless of the position where the adhesive tape is stuck.

BRIEF DESCRIPTION OF DRAWINGS

FIG. 8, which together with FIGS. 9 and 10 illustrates a procedure for peeling an adhesive tape, is a perspective view showing a state in which the push-in portion has been pushed in;

DESCRIPTION OF EMBODIMENTS

Figure 1:
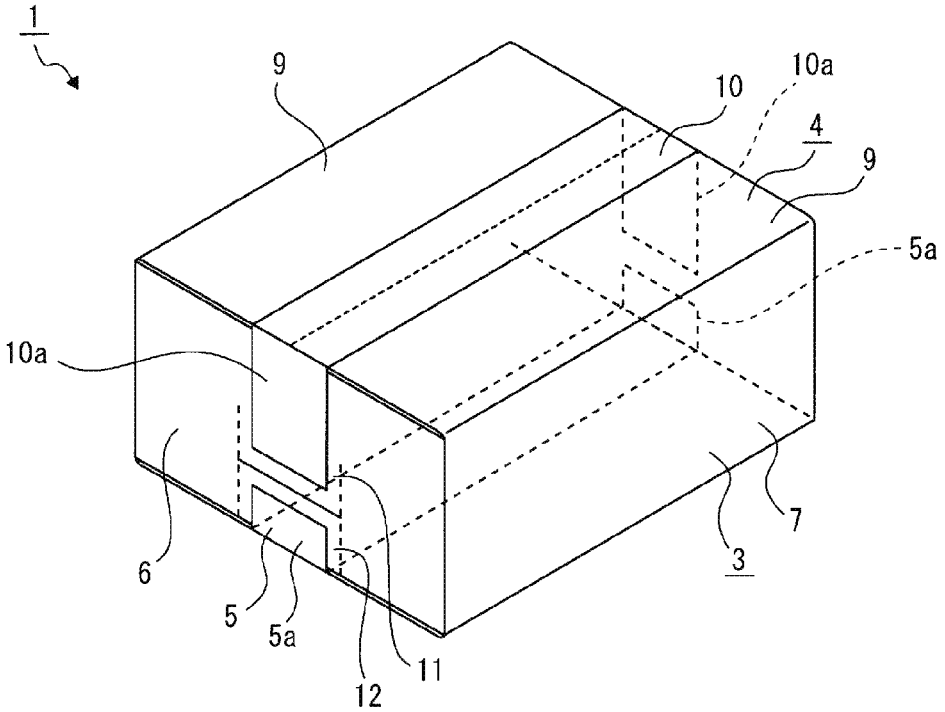
FIG. 1 illustrates an embodiment of a corrugated fiberboard box of the present invention together with FIGS. 2 to 30, and is a perspective view of the corrugated fiberboard box.

Embodiments for carrying out the corrugated fiberboard box of the present invention will be described below, referring to the attached drawings.

Note that a corrugated fiberboard box in the embodiments shown below includes a bottom surface portion, a peripheral surface portion and a top surface portion, and the peripheral surface portion includes a pair of first side surface portions (end surface portions) each of which has a pull tab portion and a push-in portion, and a pair of second side surface portions which have no pull tab portion and no push-in portion. In the following description, the direction in which the bottom surface portion and the top surface portion are arrayed is made to be a vertical direction, the direction in which the pair of first side surface portions are arrayed is made to be a front-rear direction, and the direction in which the pair of second side surface portions are arrayed is made to be a left-right direction. Note that the front-rear, vertical and left-right directions shown below are merely for convenience of description, and these directions are not limitative in carrying out the present invention.

In addition, the corrugated fiberboard box shown below has a configuration in which each of surface portions has a corrugated core sandwiched between a face liner and a back liner which are flat plate-like in shape.

Further, while each of predetermined surface portions of the corrugated fiberboard box shown below is formed with incisions, each of the incisions shown below includes a solid line-formed incision composed of a single cut and a broken line-formed (perforation-formed) incision composed of a plurality of cuts formed at regular or irregular intervals.

Furthermore, each of the incisions includes all of a configuration in which an incision is formed in only the face liner, a configuration in which an incision is formed in only the back liner, a configuration in which an incision is formed in the face liner and the core, a configuration in which an incision is formed in the back liner and the core, and a configuration in which an incision is formed in the face liner, the core and the back liner in such a manner that the incision penetrates the corrugated fiberboard ranging from the face liner to the back liner.

<Structure of Corrugated Fiberboard Box>

First, a fundamental structure of a corrugated fiberboard box 1 will be described (see FIGS. 1 to 7).

The corrugated fiberboard box 1 is formed, for example, in the shape of a rectangular parallelepiped having different values of length, width and height, in which the length in the front-rear direction is set longer than the length (width) in the left-right direction. Note that the corrugated fiberboard box 1 may be formed in a cubic shape, or may be formed in the shape of a rectangular parallelepiped in which the length in the front-rear direction and the length in the left-right direction are set equal to each other, in the shape of a rectangular parallelepiped in which the length in the front-rear direction and the length in the vertical direction are set equal to each other, or in the shape of a rectangular parallelepiped in which the length in the left-right direction and the length in the vertical direction are set equal to each other.

Figure 2:
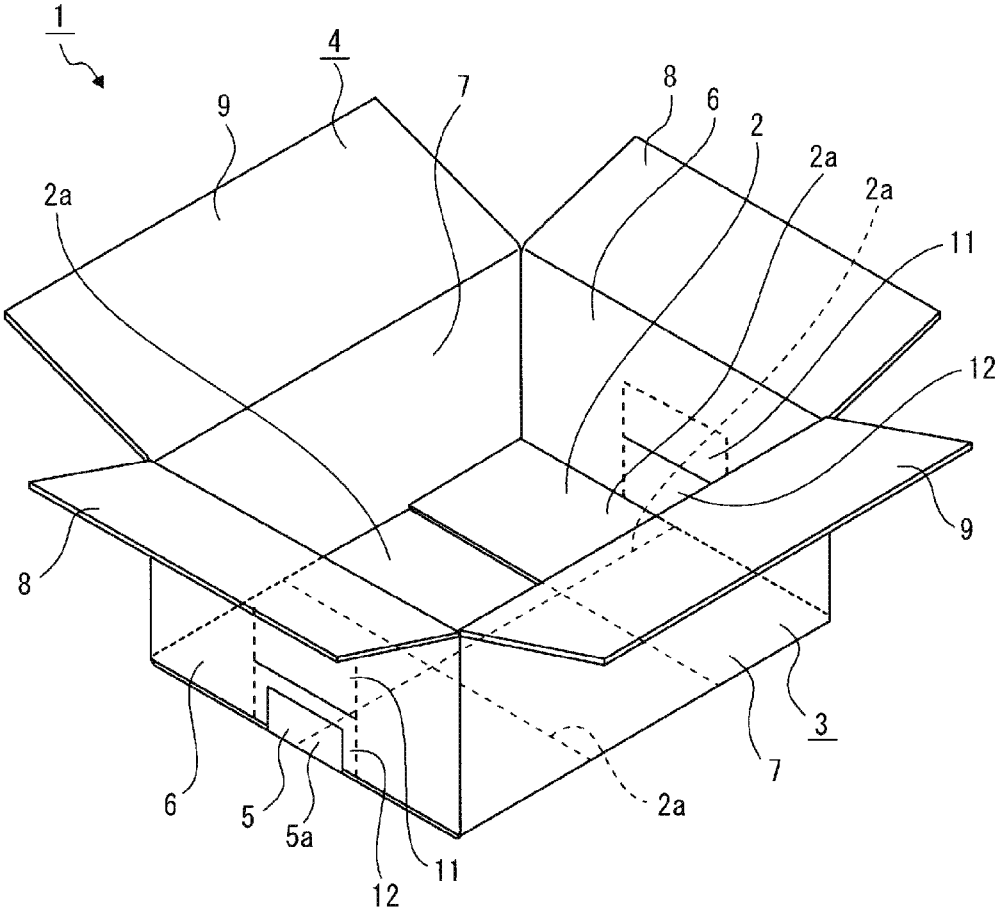
FIG. 2 is a perspective view of the corrugated fiberboard box, showing inner lap portions and outer lap portions in an opened state.

The corrugated fiberboard box 1 includes a bottom surface portion 2, a peripheral surface portion 3 and a top surface portion 4 (see FIGS. 1 and 2).

The bottom surface portion 2 includes four lap portions 2*a* and 2*a*, . . . , and, at the time of packaging an article, the four lap portions 2*a* and 2*a*, . . . are folded into a substantially planar shape and are fixed in the state of the substantially planar shape by a sticking tape 5. The sticking tape 5 is stuck to an area ranging from a line-of-juncture part of the two lap portions 2*a* and 2*a* to a part each of the peripheral surface portion 3.

The peripheral surface portion 3 includes a pair of first side surface portions 6 and 6 and a pair of second side surface portions 7 and 7. Lower edges of the pair of first side surface portions 6 and 6 are continuous with respective both front and rear side edges of the bottom surface portion 2, whereas lower edges of the pair of second side surface portions 7 and 7 are continuous with respective both left and right side edges of the bottom surface portion 2. The pair of first side surface portions 6 and 6 face in the front-rear direction and are located opposite to each other in the front-rear direction, whereas the pair of second side surface portions 7 and 7 face in the left-right direction and are located opposite to each other in the left-right direction. The first side surface portion 6 and the second side surface portion 7 are set to be the same with each other in height, and the length of the first side surface portion 6 in the left-right direction is set shorter than the length of the second side surface portion 7 in the front-rear direction.

The top surface portion 4 includes a pair of inner lap portions 8 and 8 and a pair of outer lap portions 9 and 9. One-end edges of the pair of inner lap portions 8 and 8 are continuous with respective upper edges of the pair of first side surface portions 6 and 6, whereas one-end edges of the pair of outer lap portions 9 and 9 are continuous with respective upper edges of the pair of second side surface portions 7 and 7.

The top surface portion 4 has the pair of inner lap portions 8 and 8 and the pair of outer lap portions 9 and 9 which, at the time of packaging an article, are folded into a substantially planar shape and are fixed in the state of the substantially planar shape by an adhesive tape 10. The adhesive tape 10 is stuck to an area ranging from a line-of-juncture part of the pair of outer lap portions 9 and 9 to a part each of the pair of first side surface portions 6 and 6. Note that the adhesive tape 10 and the sticking tape 5 may be of the same kind or may be of different kinds.

Figure 3:
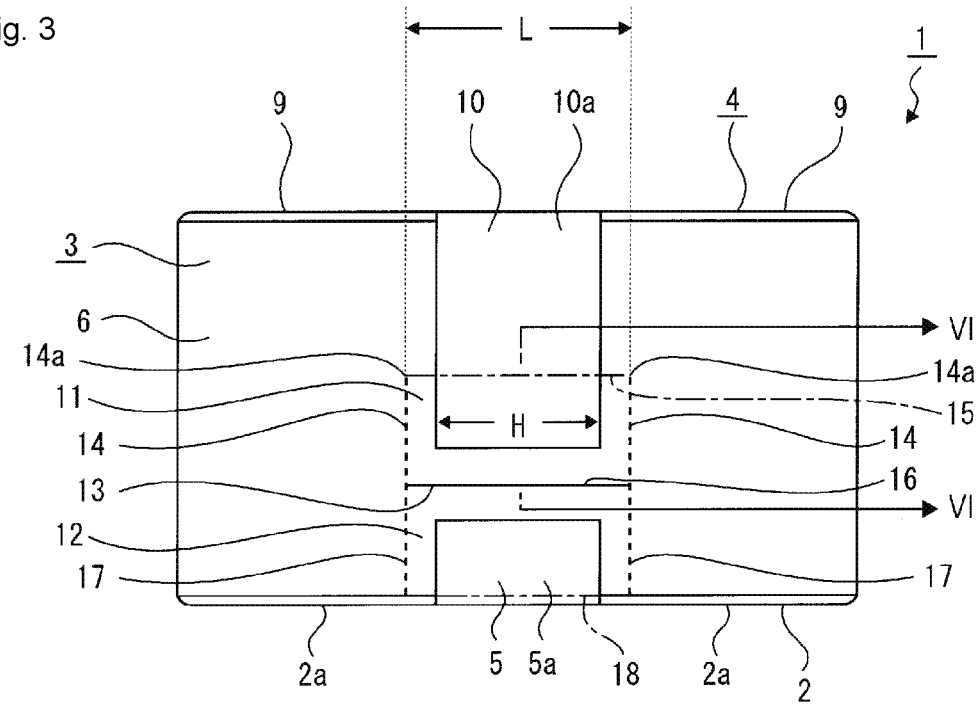
FIG. 3 is a front view of the corrugated fiberboard box.

The pair of first side surface portions 6 and 6 of the peripheral surface portion 3 are provided respectively with pull tab portions 11 and 11 and push-in portions 12 and 12, the pull tab portion 11 and the push-in portion 12 being continuous with each other in the vertical direction (see FIGS. 1 to 3). The pull tab portions 11 and 11 are portions that are drawn outward during package opening, whereas the push-in portions 12 and 12 are portions that are pushed in during package opening. Note that the pull tab portion 11 and the push-in portion 12 may be formed only in the first side surface portion 6 on one side.

The pull tab portion 11 is formed as an area surrounded by four solid or broken line-formed incisions. As depicted in FIG. 3, the four incisions include a first incision 13 extending in the left-right direction, a pair of second incisions 14 and 14 extending in the vertical direction, and a third incision 15 extending in the left-right direction.

The first incision 13 is formed as a boundary line of the push-in portion 12, and is formed, for example, in the form of a solid line that penetrates the first side surface portion 6. Note that the first incision 13 may be formed in the form of a broken line. In addition, the first incision 13 may be formed, for example, such that short parts where the incision is not present are present at a few parts in the whole part. Where the first incision 13 is formed in this way, unintentional pushing-in (bending) of the pull tab portion 11 and the push-in portion 12 during transportation or the like is not liable to occur, and the pull tab portion 11 and the push-in portion 12 can be bent with a small force, so that enhanced workability during package opening is ensured.

Note that where the first incision 13 is formed in the form of a solid line that penetrates the first side surface portion 6, the force required for drawing out the pull tab portion 11 during package opening is further reduced, so that the pull tab portion 11 can be drawn out easily. In addition, since the first incision 13 is formed as a boundary line of the push-in portion 12 as above-mentioned, the formation of the first incision 13 in the form of a solid line that penetrates the first side surface portion 6 ensures that the force required for pushing in the push-in portion 12 during package opening is also further reduced, so that the push-in portion 12 can be pushed in easily.

The second incisions 14 and 14 are formed with their lower ends continuous with respective both ends of the first incision 13, and are formed in the state of being spaced apart from each other in the left-right direction and parallel to each other. Therefore, the second incisions 14 and 14 are located in the state of being parallel to both left and right side edges of the adhesive tape 10. The second incision 14 is formed, for example, in the form of a broken line that penetrates the first side surface portion 6.

Figure 4:
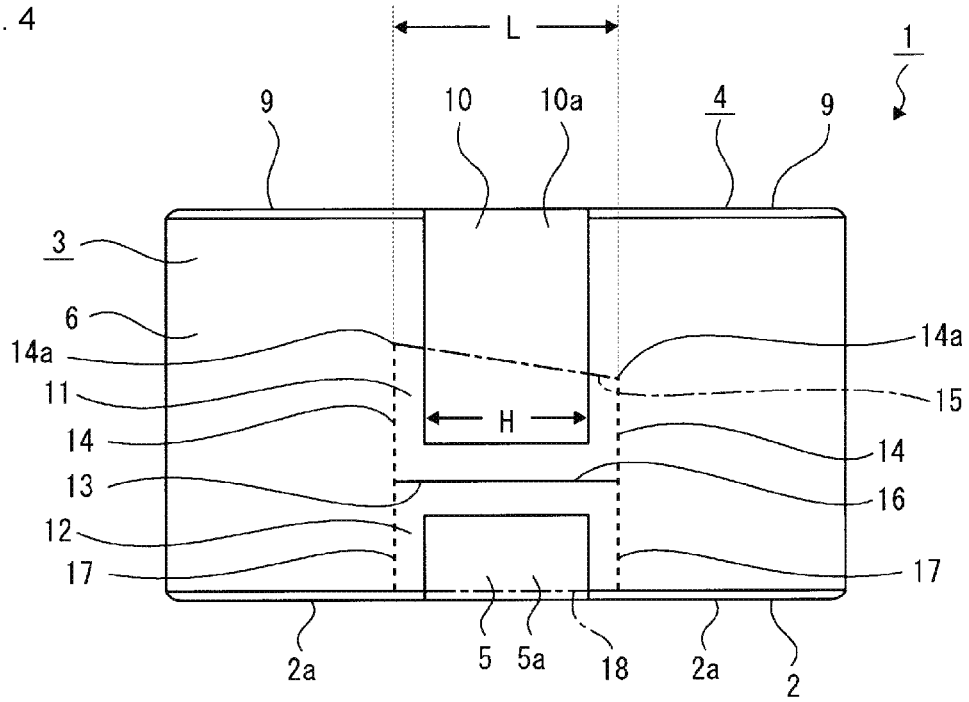
FIG. 4 is a front view of the corrugated fiberboard box, showing an example in which second incisions are different from each other in length.
Figure 5:
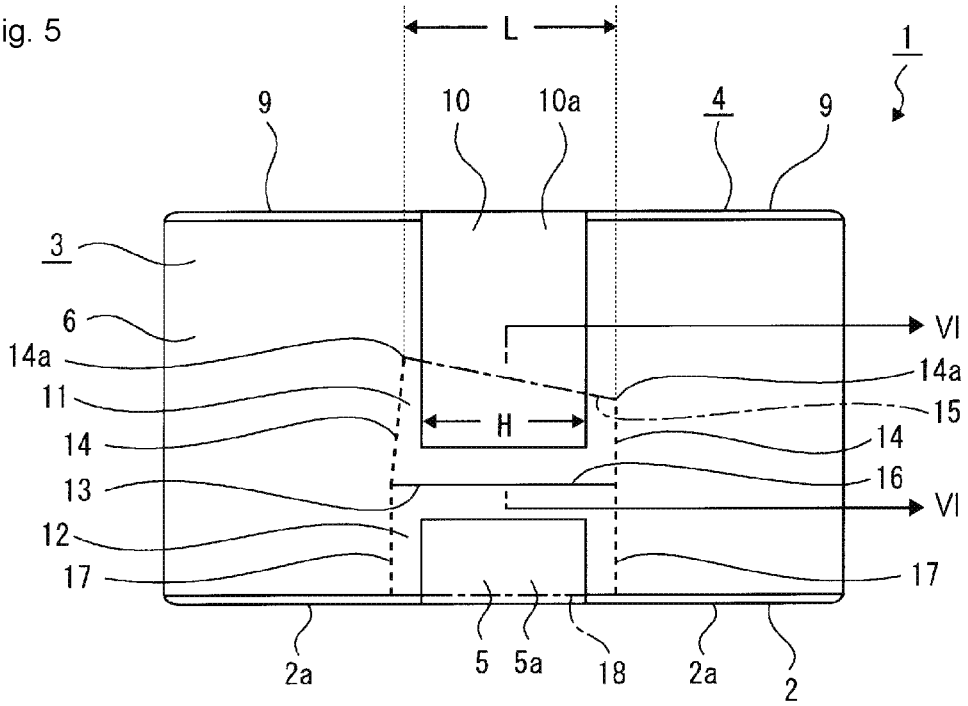
FIG. 5 is a front view of the corrugated fiberboard box, showing an example in which at least one of the second incisions is inclined.

When upper ends of the second incisions 14 and 14, specifically, those ends of the second incisions 14 and 14 which are located opposite to the push-in portion 12 are called tape-side incision ends 14*a* and 14*a*, the distance L between the tape-side incision ends 14*a* and 14*a* in the width direction of the adhesive tape 10 is set greater than the width H of the adhesive tape 10. For example, the distance L is set greater than the width H by 2 mm to 10 mm. Of the adhesive tape 10, an end portion 10*a* in the longitudinal direction is stuck to the pull tab portion 11 in an appropriate state, and, in this case, spacing (margin) of 1 mm to 5 mm is formed individually between the left and right side edges of the adhesive tape 10 and the second incisions 14 and 14. Note that there may be cases where, for example as shown in FIGS. 4 and 5, the vertical positions of the tape-side incision ends 14*a* and 14*a* are different from each other because the second incisions 14 and 14 are different from each other in length or because at least one of the second incisions 14 and 14 is inclined or because of some other reason, and, even in such cases, the distance L between the tape-side incision ends 14*a* and 14*a* in the width direction of the adhesive tape 10 is set greater than the width H of the adhesive tape 10.

Figure 6:
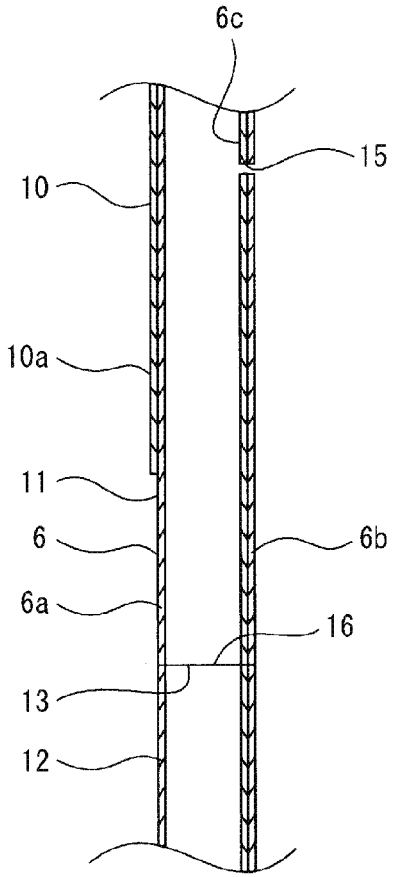
FIG. 6 is an enlarged sectional view taken along line VI-VI of FIG. 3.

The third incision 15 has both ends made continuous with respective upper ends of the second incisions 14 and 14, and is formed in the form of a solid or broken line that does not have an incision in a face liner 6*a* of the first side surface portion 6 but has an incision in only a back liner 6*b* of the first side surface portion 6 or in the back liner 6*b* and a core 6*c* of the first side surface portion 6 (see FIG. 6). Note that in FIG. 6, the size of the incision is exaggerated for easier understanding (the same applies also to the subsequent drawings).

Since the third incision 15 is thus formed to have an incision in only the back liner 6*b* or in the back liner 6*b* and the core 6*c*, the third incision 15 functions as a folding line when the pull tab portion 11 is drawn outward. Note that the third incision 15 may be formed in the form of a solid or broken line that penetrates the first side surface portion 6.

The push-in portion 12 is formed as an area surrounded by four solid or broken line-formed incisions. As shown in FIG. 3, the four incisions include a fourth incision 16 extending in the left-right direction, a pair of fifth incisions 17 and 17 extending in the vertical direction, and a sixth incision 18 extending in the left-right direction.

The fourth incision 16 is formed as a boundary line of the pull tab portion 11, serves also as the first incision 13, and is formed, for example, in the form of a solid line that penetrates the first side surface portion 6. Note that the fourth incision 16 may be formed in the form of a broken line.

The fifth incisions 17 and 17 have their upper ends continuous with respective both ends of the fourth incision 16, and are formed in the state of being spaced apart from each other in the left-right direction and parallel to each other. Therefore, the fifth incisions 17 and 17 are located in the state of being parallel to both left and right side edges of the sticking tape 5. The fifth incision 17 may, for example, be formed in the form of a broken line that penetrates the first side surface portion 6.

The sixth incision 18 functions as a folding line when the push-in portion 12 is pushed inward, has both ends continuous with respective lower ends of the fifth incisions 17 and 17, and is made to coincide with a lower edge of the first side surface portion 6, in other words, a folded part that is a boundary part between the first side surface portion 6 and the bottom surface portion 3, for example. Since the sixth incision 18 is preliminarily provided with a folding line, therefore, an incision may not necessarily be formed at the sixth incision 18.

Where an incision is thus not formed at the sixth incision line 18, a high strength of the first side surface portion 6 can be ensured. In addition, where the sixth incision 18 for forming the push-in portion 12 is made to coincide with the lower edge of the first side surface portion 6, the push-in portion 12 can be pushed in easily, and the need for a processing step for forming a solid or broken line-formed incision at the sixth incision 18 is eliminated, so that the corrugated fiberboard box 1 can be manufactured at a lower cost and in a shorter time.

Note that an incision may be formed at the sixth incision 18; in this case, the sixth incision 18 is formed in the form of a solid or broken line that does not have an incision in the face liner 6*a* of the first side surface portion 6 but has an incision in only the back liner 6*b* of the first side surface portion 6 or in the back liner 6*b* and the core 6*c* of the first side surface portion 6. It is to be noted, however, that for enabling the push-in portion 12 to be pushed in easily, the sixth incision 18 may be formed in the form of a solid or broken line that has an incision in only the face liner 6*a* or in the face liner 6*a* and the core 6*c*. Note that the sixth incision 18 may be formed in the form of a broken line that penetrates the first side surface portion 6.

Figure 7:
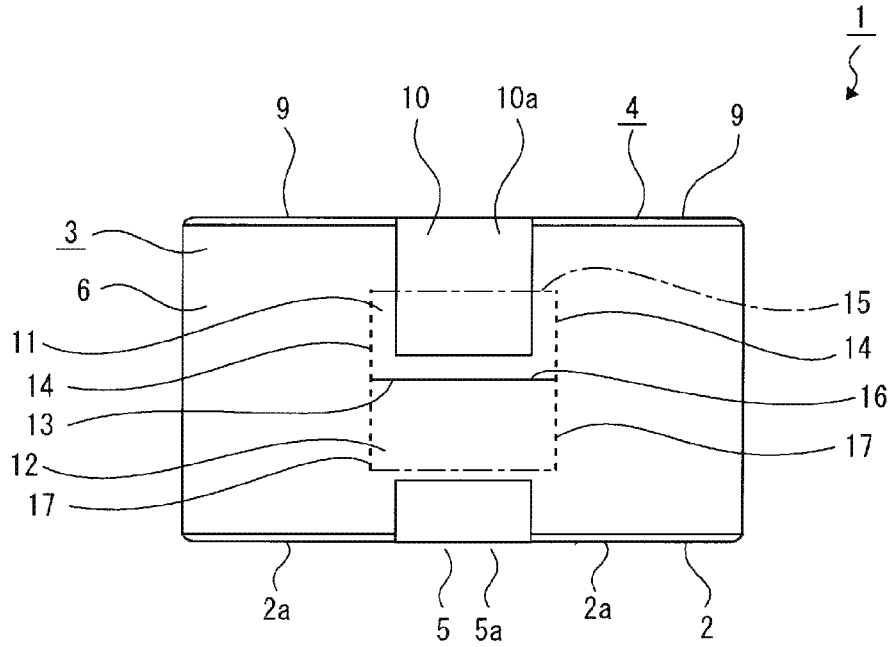
FIG. 7 is a front view showing an example in which a pull tab portion and a push-in portion are formed at a substantially central part of a first side surface portion.

While an example in which the sixth incision 18 for forming the push-in portion 12 coincides with the lower edge of the first side surface portion 6 has been shown above, the sixth incision 18 may be configured to be present at other position than the lower edge of the first side surface portion 6. For example, as shown in FIG. 7, a pull tab portion 11 and a push-in portion 12 may be formed in a substantially central area of the first side surface portion 6.

Besides, the third incision 15 for forming the pull tab portion 11 may be made to coincide with an upper edge of the first side surface portion 6, in other words, a folded part that is a boundary part between the first side surface portion 6 and the inner lap portion 8.

With the third incision 15 made to coincide with the upper edge of the first side surface portion 6, the pull tab portion 11 can be drawn out easily, and the formation of an incision in the form of a solid or broken line at the third incision 15 can be omitted, so that the corrugated fiberboard box 1 can be manufactured at a lower cost and in a shorter time.

<Peeling Operation for Adhesive Tape>

A procedure of a peeling operation for the adhesive tape 10 will be described below (see FIGS. 1, and 8 to 14).

In a state after an article is packaged in the corrugated fiberboard box 1 and before a peeling operation is conducted, as shown in FIG. 1, end portions 5*a* and 5*a* on both sides in the longitudinal direction of the sticking tape 5 are stuck to the push-in portions 12 and 12, respectively. In this instance, both left and right side edges of the end portion 5*a* are located inside the fifth incisions 17 and 17, the upper edge of the end portion 5*a* is located on the lower side of the fourth incision 16, and the end portion 5*a* is stuck in the state of not lying across the push-in portion 12.

Besides, in this instance, the end portions 10*a* and 10*a* on both sides in the longitudinal direction of the adhesive tape 10 are stuck to the pull tab portions 11 and 11, as above-mentioned. In this instance, both left and right side edges of the end portion 10*a* are located inside the second incisions 14 and 14, the lower edge of the end portion 10*a* is located on the upper side of the first incision 13, spacings are formed individually between both left and right side edges of the end portion 10*a* and the second incisions 14 and 14 and between the lower edge of the end portion 10*a* and the first incision 13, and the end portion 10*a* is stuck in the state of not lying across the pull tab portion 11.

Figure 8:
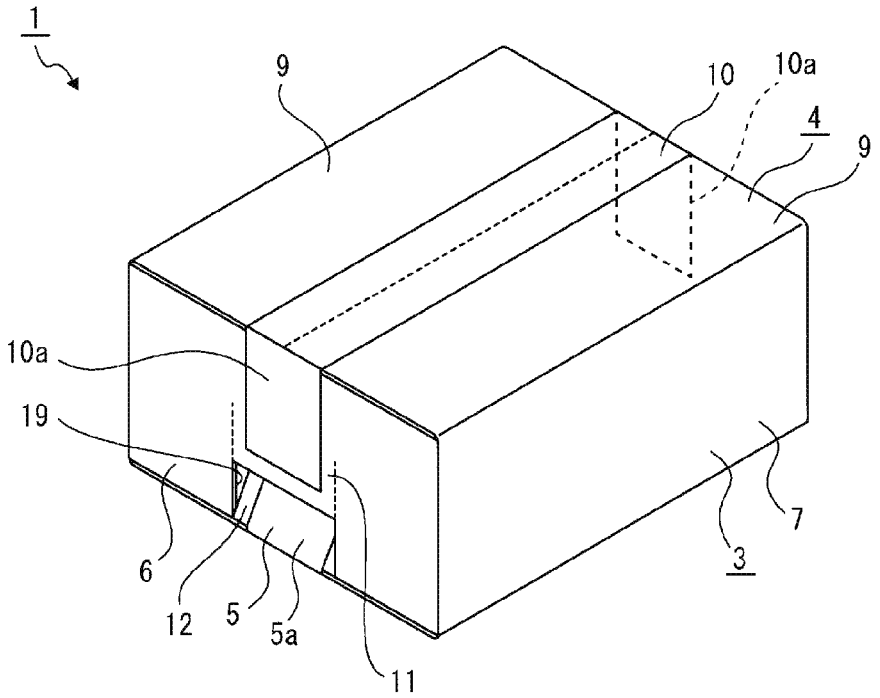

In the above-mentioned state, first, the push-in portion 12 is pushed, whereby the push-in portion 12 is pushed inward (see FIG. 8). When the push-in portion 12 is pushed inward, cutting at the fifth incisions 17 and 17 and bending at the sixth incision 18 are brought about by the pushing force. In this case, the end portion 5*a* of the sticking tape 5 is pushed inward together with the push-in portion 12. Since the end portion 5*a* of the sticking tape 5 is stuck in the state of not lying across the push-in portion 12, the adhesion of the sticking tape 5 does not act as a resistance against the force exerted for pushing in the push-in portion 12 when the push-in portion 12 is pushed in, so that the push-in portion 12 can be smoothly pushed in with a small force.

When the push-in portion 12 is pushed inward, an opening 19 is formed at that part of the first side surface portion 6 at which the push-in portion 12 has been present.

Figure 9:
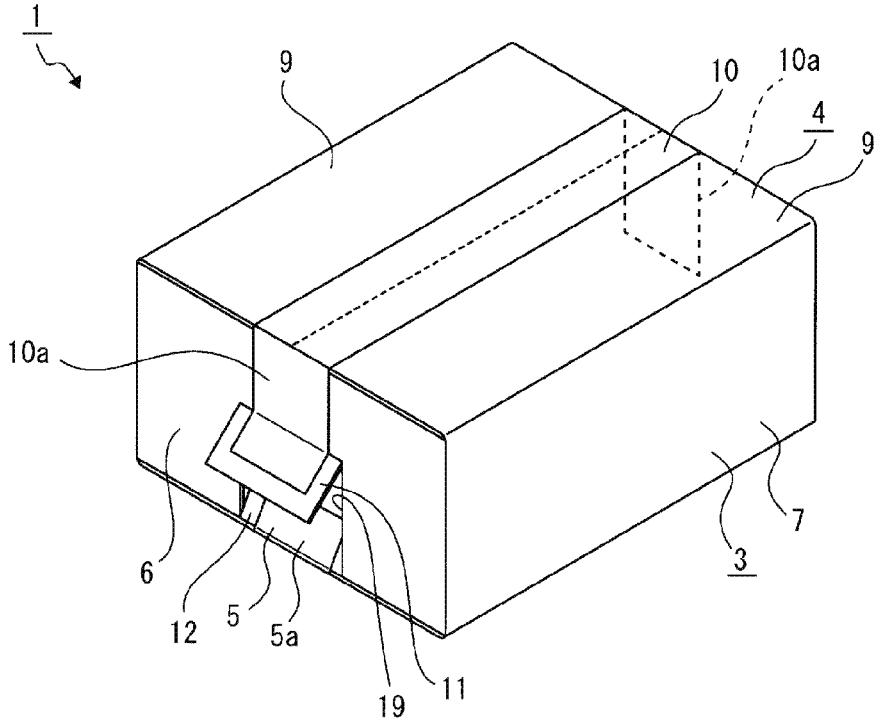
FIG. 9 is a perspective view showing a state in which the pull tab portion has been drawn out.

Next, a finger is inserted into the opening 19 to grasp the pull tab portion 11, and the pull tab portion 11 is drawn outward (see FIG. 9). When the pull tab portion 11 is drawn outward, cutting at the second incisions 14 and 14 and bending at the third incision 15 are brought about by the drawing-out force, and the end portion 10*a* of the adhesive tape 10 is also drawn outward together with the pull tab portion 11.

In this case, the distance L between the second incisions 14 and 14 at the pull tab portion 11 is set greater than the width H of the adhesive tape 10, a spacing is formed between the lower edge of the end portion 10*a* and the first incision 13, and the end portion 10*a* is stuck in the state of not lying across the pull tab portion 11. Therefore, the adhesion of the adhesive tape 10 does not act as a resistance against the force exerted for drawing out the pull tab portion 11 when the pull tab portion 11 is drawn out, so that the pull tab portion 11 can be smoothly drawn out with a small force.

Figure 10:
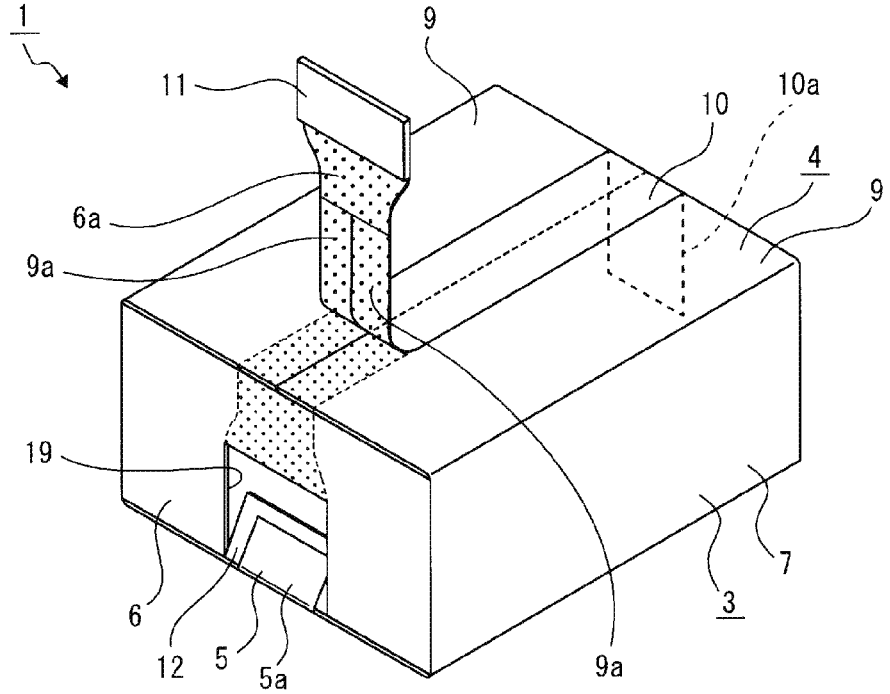
FIG. 10 is a perspective view showing a state in which the drawn-out pull tab portion is pulled and the adhesive tape is thereby peeled.

Subsequently, the pull tab portion 11 thus drawn out is pulled along the adhesive tape 10 (see FIG. 10). When the pull tab portion 11 is pulled, cutting of the face liner 6*a* at the third incision 15 and peeling of a part of the face liner 6*a* on the upper side of the third incision 15 are brought about by the pulling force, and, further, the face liners 9*a* and 9*a* at those parts of the outer lap portions 9 and 9 to which the adhesive tape 10 has been stuck are gradually peeled together with the adhesive tape 10. Note that the satin-shaded area in FIG. 10 indicates a peel mark left after the peeling.

In this instance, of each of the face liner 6*a* and the face liners 9*a* and 9*a*, either the whole part in the thickness direction is peeled off from the core or only a surface part is peeled off.

Further, with the pull tab portion 11 pulled, the face liner 6*a* at the first side surface portion 6 that is located on the opposite side from the side of the pull tab portion 11 drawn out is peeled off together with the end portion 10*a* of the adhesive tape 10 on the opposite side, whereby the whole part of the adhesive tape 10 is peeled off from the corrugated fiberboard box 1.

Note that while an example in which the operation of peeling the adhesive tape 10 is conducted from the side of the first side surface portion 6 on one side has been shown in the above description, it is also possible, in the case where the pull tab portions 11 and 11 and the push-in portions 12 and 12 are provided at both the first side surface portions 6 and 6, to peel the adhesive tape 10 by pushing both the push-in portions 12 and 12 inward, then drawing both the pull tab portions 11 and 11 outward and pulling them along the adhesive tape 10.

Figure 11:
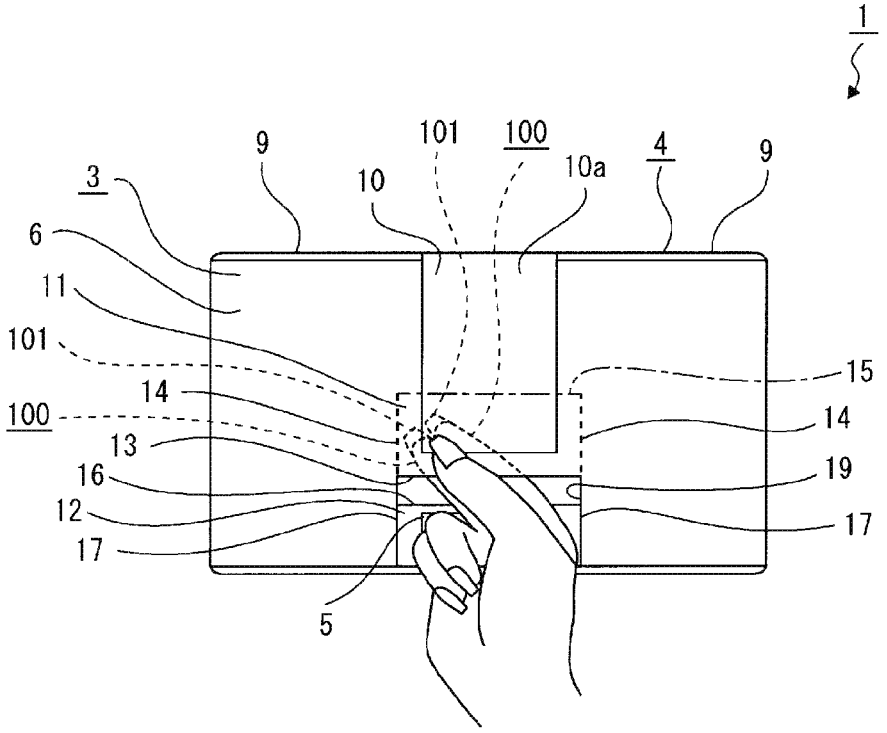
FIG. 11 is a front view showing a state in which a finger has been inserted via an opening and the pull tap portion has been grasped.

In addition, in the corrugated fiberboard box 1, the width of the pull tab portion 11 in the left-right direction is set greater than the width of the adhesive tape 10, and the size of the pull tab portion 11 in the left-right direction is thus set large. Therefore, when fingers 100 are inserted via the opening 19 so as to draw out the pull tab portion 11, as shown in FIG. 11, nails 101 of the inserted fingers 100 are not liable to be caught on the second incisions 14 and 14, and tip portions of the fingers 100 are not liable to be put on the outside of the pull tab portion 11 in the left-right direction; accordingly, it is possible to grasp only the pull tab portion 11 by the fingers 100 and to easily draw out the pull tab portion 11.

Further, in the corrugated fiberboard box 1, the pair of second incisions 14 and 14 are formed in the state of extending in the vertical direction orthogonally to the width direction of the adhesive tape 10 and being parallel to each other.

Therefore, the distance between the second incisions 14 and 14 is greater than the width H of the adhesive tape 10 at any position in the lengthwise direction of the second incisions 14 and 14 (the vertical direction), and the end portion 10*a* of the adhesive tape 10 does not cover the second incisions 14 and 14, regardless of the position in the vertical direction at which a tip edge of the end portion 10*a* is present. Consequently, the adhesive tape 10 can be peeled easily and reliably, regardless of the position where the adhesive tape 10 is stuck.

Figure 12:
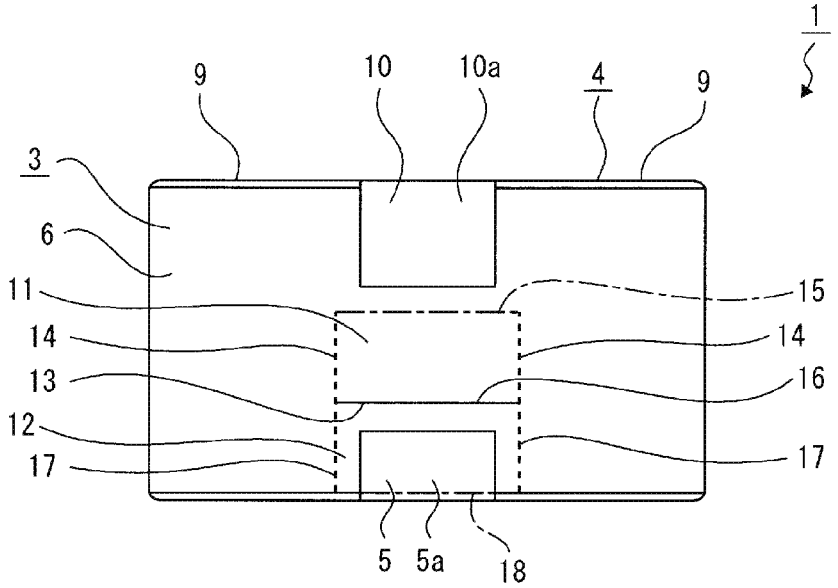
FIG. 12 is a front view showing a state in which an end portion of the adhesive tape has been stuck at a position on an upper side of the pull tab portion.
Figure 13:
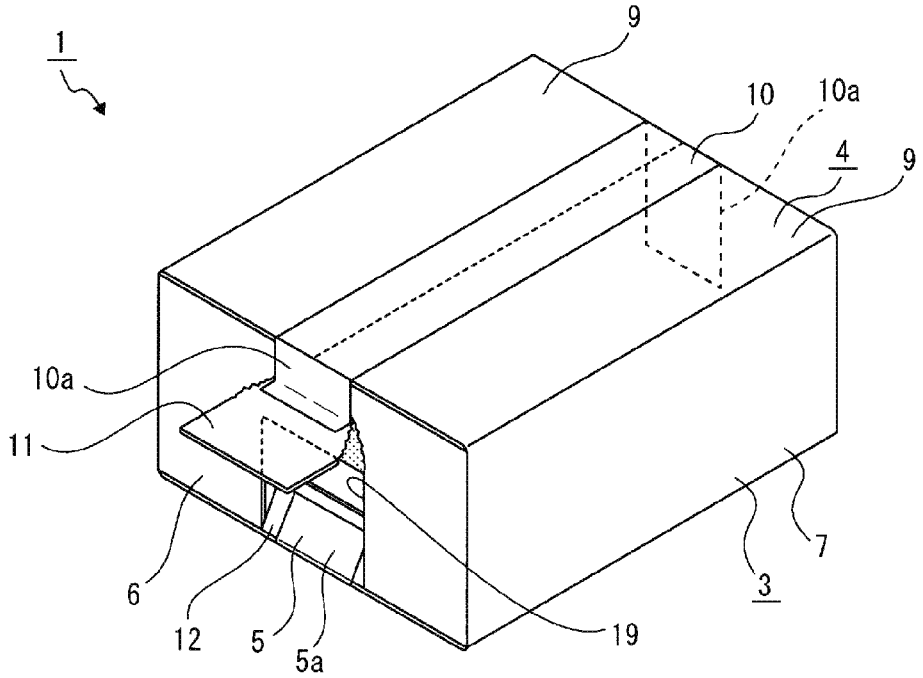
FIG. 13 is a perspective view showing a state in which the pull tab portion has been drawn out and pulled, under the condition where the end portion of the adhesive tape has been stuck at a position on the upper side of the pull tab portion.

While an example in which the end portion 10*a* of the adhesive tape 10 is stuck to the pull tab portion 11 has been shown in the above description, the end portion 10*a* may be stuck at a position on the upper side of the pull tab portion 11 in the case where the end portion 10*a* is stuck by a manual operation, for example (see FIG. 12).

In the corrugated fiberboard box 1, however, the distance L between the tape-side incision ends 14*a* and 14*a* of the second incisions 14 and 14 in the width direction of the adhesive tape 10 is set greater than the width H of the adhesive tape 10. Therefore, when the pull tab portion 11 is pulled and the face liner 6*a* of the first side surface portion 6 is thereby gradually peeled off, it is highly possible for both left and right side edges of the face liner 6*a*, the width of which is gradually decreased as the peeling proceeds, to respectively reach both left and right side edges of the end portion 10*a* without reaching the lower edge of the end portion 10*a* (see FIG. 13).

Figure 14:
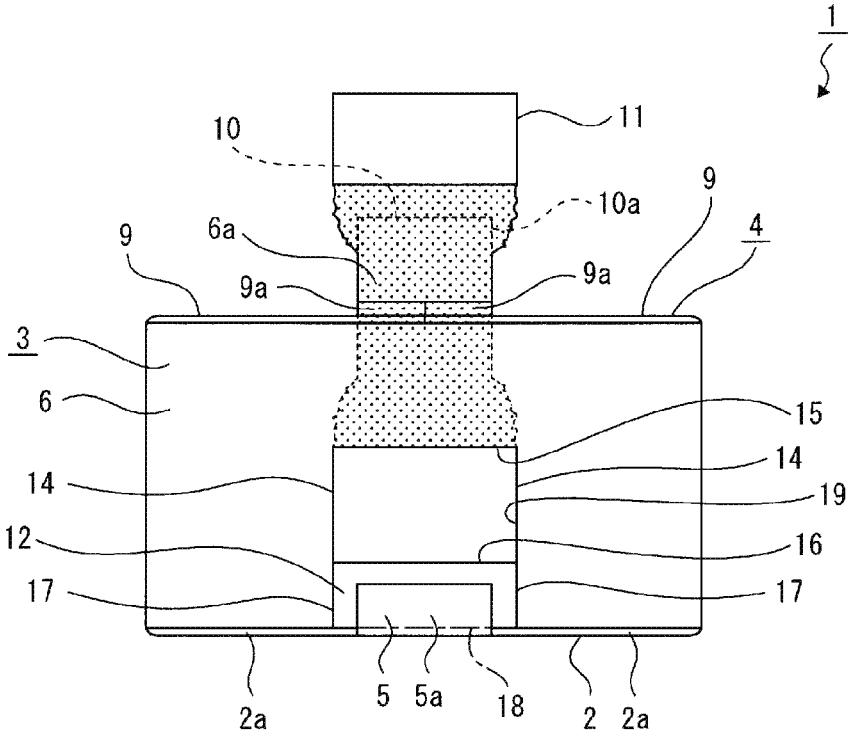
FIG. 14 is a front view showing a state in which the pull tab portion is pulled and the adhesive tape is thereby peeled, under the condition where the end portion of the adhesive tape has been stuck at a position on the upper side of the pull tab portion.

In this instance, the tip part of the end portion 10*a* has already been peeled off together with the face liner 6*a*, and the adhesive tape 10 can be peeled by further pulling the pull tab portion 11 along the adhesive tape 10 (see FIG. 14). Note that the satin-shaded area in FIGS. 13 and 14 indicates a peel mark left after the peeling.

Thus, in the corrugated fiberboard box 1, since the distance L between the tape-side incision ends 14*a* and 14*a* in the width direction of the adhesive tape 10 is set greater than the width H of the adhesive tape 10, it is highly possible for both left and right side edges of the face liner 6*a* of the first side surface portion 6 to respectively reach both left and right side edges of the end portion 10*a* during when the face liner 6*a* is gradually peeled by pulling the pull tab portion 11.

Therefore, even in the case where the end portion 10*a* is not stuck to the pull tab portion 11, the adhesion of the adhesive tape 10 is not liable to act as a resistance against the force exerted for peeling the adhesive tape 10, and the adhesive tape 10 can be easily peeled regardless of the position where the adhesive tape 10 is stuck.

<Modifications>

Each of modifications of the pull tab portion or the push-in portion will now be described below (see FIGS. 15 to 25).

Note that each of the modifications of the pull tab portion or push-in portion shown below is different from the above-described pull tab portion 11 or push-in portion 12 in only the configuration of a part or parts, and, therefore, only the part or parts different as compared with the pull tab portion 11 or the push-in portion 12 will be described in detail, whereas the other parts will be denoted by the same reference symbols used for the equivalent parts in the pull tab portion 11 or the push-in portion 12 and descriptions thereof will be omitted.

Figure 15:
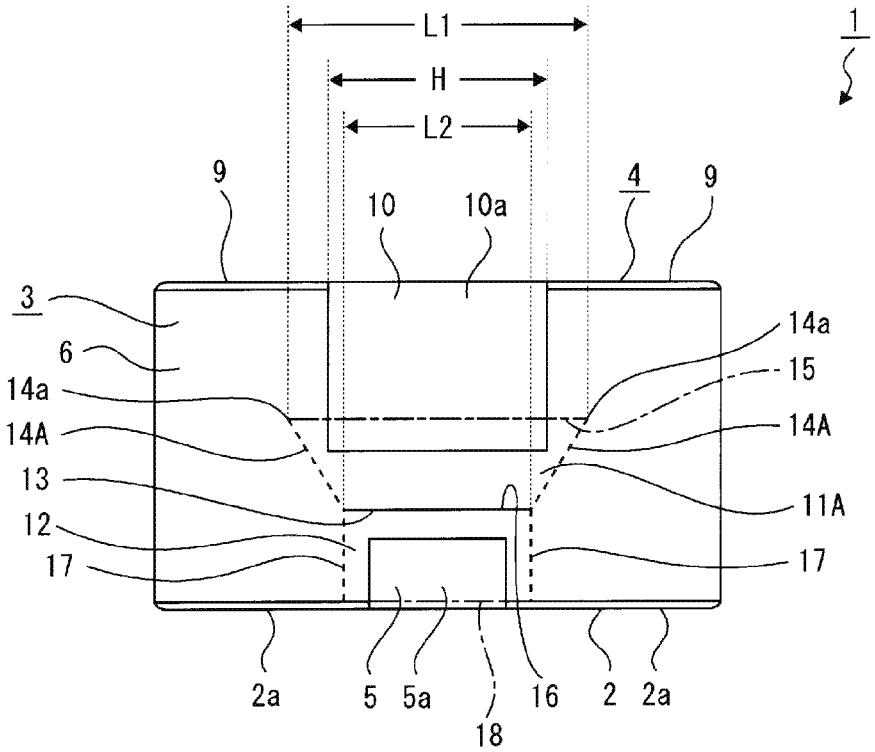
FIG. 15 is a front view showing a first modification.
Figure 16:
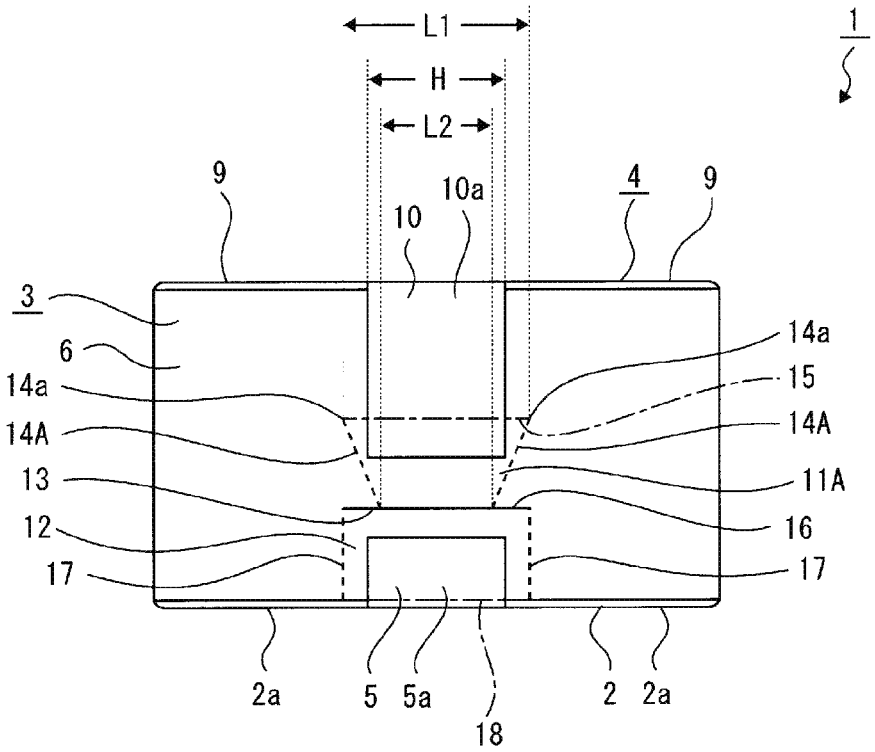
FIG. 16 is a front view showing an example in which a lower edge of a pull tab portion is set smaller than an upper edge of a push-in portion in the first modification.

First, a pull tab portion 11A according to a first modification will be described (see FIGS. 15 and 16).

The pull tab portion 11A is formed in an isosceles trapezoidal shape in which second incisions 14A and 14A are inclined in such a manner as to be spaced farther away from each other in going upward. The distance L1 between the tape-side incision ends 14*a* and 14*a* (upper ends) of the second incisions 14A and 14A of the pull tab portion 11A in the width direction of the adhesive tape 10 is set greater than the width H of the adhesive tape 10, and the distance L2 between lower ends of the second incisions 14A and 14A in the width direction of the adhesive tape 10 is set smaller than the width H of the adhesive tape 10.

The lower ends of the second incisions 14A and 14A may be continuous with respective both ends of the first incision 13 (see FIG. 15), or may be continuous with respective other parts than both ends of the first incision 13 (see FIG. 16); in short, it is sufficient that the size of the pull tab portion 11A in the left-right direction is determined according to the width size of the adhesive tape 10.

Even in the case where the first side surface portion 6 is formed with the pull tab portion 11A, the adhesive tape 10 can be stuck in a state in which the end portion 10*a* thereof does not lie across the pull tab portion 11A. Therefore, the adhesion of the adhesive tape 10 does not act as a resistance against the force exerted for drawing out the pull tab portion 11A when the pull tab portion 11A is drawn out. Accordingly, the pull tab portion 11 can be smoothly drawn out with a small force.

In addition, even when the end portion 10*a* of the adhesive tape 10 is stuck at a position on the upper side of the pull tab portion 11 in the case where the pull tab portion 11A is formed, the configuration in which the distance L1 between the tape-side incision ends 14*a* and 14*a* of the second incisions 14A and 14A in the width direction of the adhesive tape 10 is set greater than the width H of the adhesive tape 10 ensures that it is highly possible for both left and right side edges of the face liner 6*a* of the first side surface portion 6 to respectively reach both left and right side edges of the end portion 10*a* when the face liner 6*a* is gradually peeled off by pulling the pull tab portion 11A.

Therefore, even in the case where the end portion 10*a* is not stuck to the pull tab portion 11A, the adhesion of the adhesive tape 10 is not liable to act as a resistance against the force exerted for peeling the adhesive tape 10. Accordingly, the adhesive tape 10 can be easily peeled regardless of the position where the adhesive tape 10 is stuck.

Note that while, as a first modification, the pull tab portion 11A having an isosceles trapezoidal shape has been shown as an example in the above description, it is necessary for the corrugated fiberboard box 1 to only have a configuration wherein at least the distance L1 between the upper ends of the second incisions 14A and 14A, namely, between the tape-side incision ends 14*a* and 14*a* in the width direction of the adhesive tape 10 is set greater than the width H of the adhesive tape 10. So long as such a configuration is fulfilled by the pull tab portion, the pull tab portion can be formed in various shapes.

Figure 17:
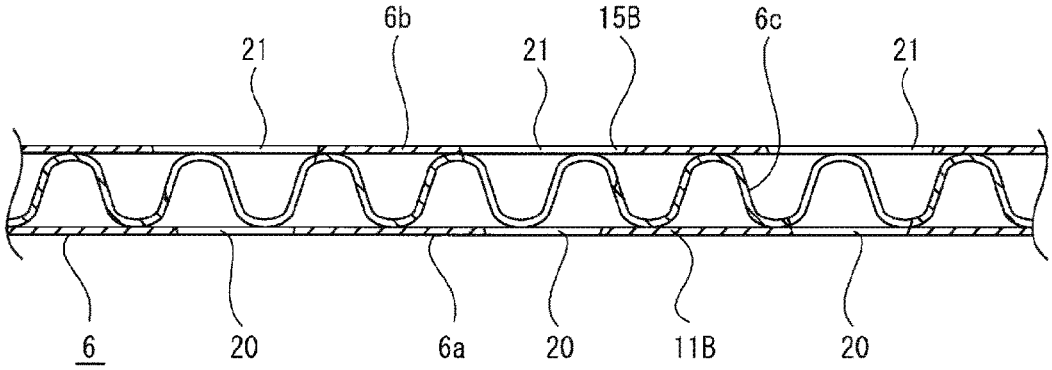
FIG. 17 is an enlarged sectional view showing a second modification.

Now, a pull tab portion 11B according to a second modification will be described below (see FIGS. 17 and 18).

The pull tab portion 11B has a configuration wherein a third incision 15B is formed in the form of a broken line that penetrates the first side surface portion 6. Of the third incision 15B, cuts 20, 20, . . . in the face liner 6*a* are set smaller in length than cuts 21, 21, . . . in the back liner 6*b* (see FIG. 17). Note that FIG. 17 is an enlarged horizontal sectional view taken along a section containing the third incision 15B.

Figure 18:
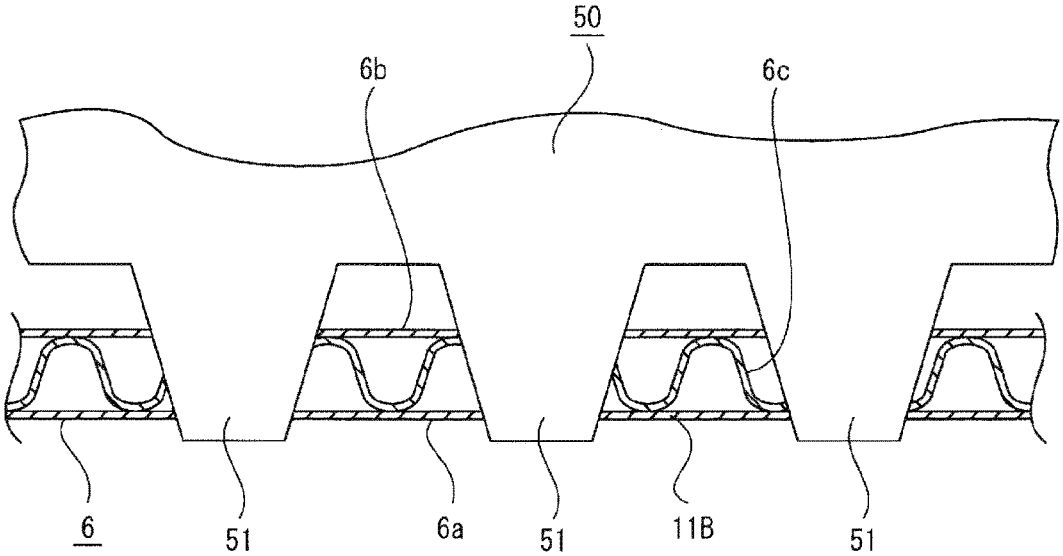
FIG. 18 is an enlarged sectional view showing a state in which an incision is formed by an incision forming apparatus in the second modification.

Such a third incision 15B in which the cuts 20, 20, . . . are different from the cuts 21, 21, . . . in length can be formed by a comb-tooth-shaped incision forming apparatus 50, as shown in FIG. 18. The incision forming apparatus 50 has trapezoidal cutting teeth 51, 51, . . . arrayed at regular intervals. By inserting the cutting teeth 51, 51, . . . into the first side surface portion 6 from the back side, the cuts 20, 20, . . . and the cuts 21, 21, . . . can be formed simultaneously.

By using the incision forming apparatus 50, therefore, the third incision 15B can be formed easily and speedily. Accordingly, the corrugated fiberboard box 1 can be manufactured with enhanced mass productivity through a facilitated production process and a shortened production time.

In addition, since the third incision 15B has the cuts 20, 20, . . . in the face liner 6*a* which are set shorter in length than the cuts 21, 21, . . . in the back liner 6*b*, the pull tab portion 11B is hard to displace in the direction of pushing inward but is easy to displace in the direction of drawing outward. Further, since the cuts 20, 20, . . . in the face liner 6*a* are set shorter in length than the cuts 21, 21, . . . in the back liner 6*b*, the pull tab portion 11B is hard to cut off in the direction of pushing inward but is easy to cut off in the direction of drawing outward. Accordingly, the operation of peeling the adhesive tape 10 can be easily carried out while securing a high strength of the corrugated fiberboard box 1.

Since the pull tab portion 11B is thus hard to push in and easy to draw out, unintentional pushing-in of the pull tab portion 11B during transportation or the like is not liable to occur, and the pull tab portion 11B can be easily drawn out. Since the adhesive tape 10 is stuck in the state of not lying across the pull tab portion, there may arise a problem that the adhesion of the adhesive tape 10 does not act as a resistance against a displacement of the pull tab portion in the pushing-in direction and that the pull tab portion is liable to be pushed in. In the corrugated fiberboard box 1, however, such a problem can be prevented by the formation of the pull tab portion 11B which is configured in such a manner as not to be easily pushed in.

Note that the configuration in which the cuts in the face liner 6*a* are set shorter in length than the cuts in the back liner 6*b* can be applied also to the second incisions, in addition to the third incision 15B. Where the configuration wherein the cuts in the face liner 6*a* are set shorter in length than the cuts in the back liner 6*b* is applied to the second incisions, the pull tab portion becomes harder to push in, and the possibility of unintentional pushing-in of the pull tab portion during transportation or the like is further lowered. In addition, where the configuration wherein the cuts in the face liner 6*a* are set shorter in length than the cuts in the back liner 6*b* is applied to the second incisions, the pull tab portion 11B becomes harder to cut off in the direction of pushing inward and becomes easier to cut off in the direction of drawing outward. Accordingly, the operation of peeling the adhesive tape 10 can be carried out more easily while securing a higher strength of the corrugated fiberboard box 1.

Figure 19:
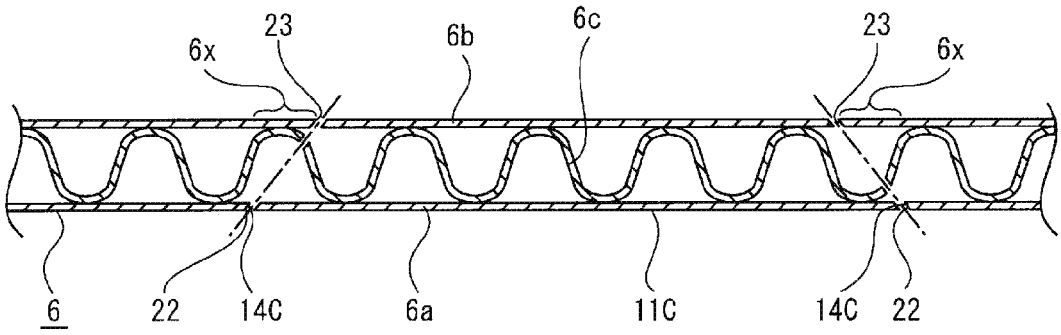
FIG. 19 is an enlarged sectional view showing a third modification.
Figure 20:
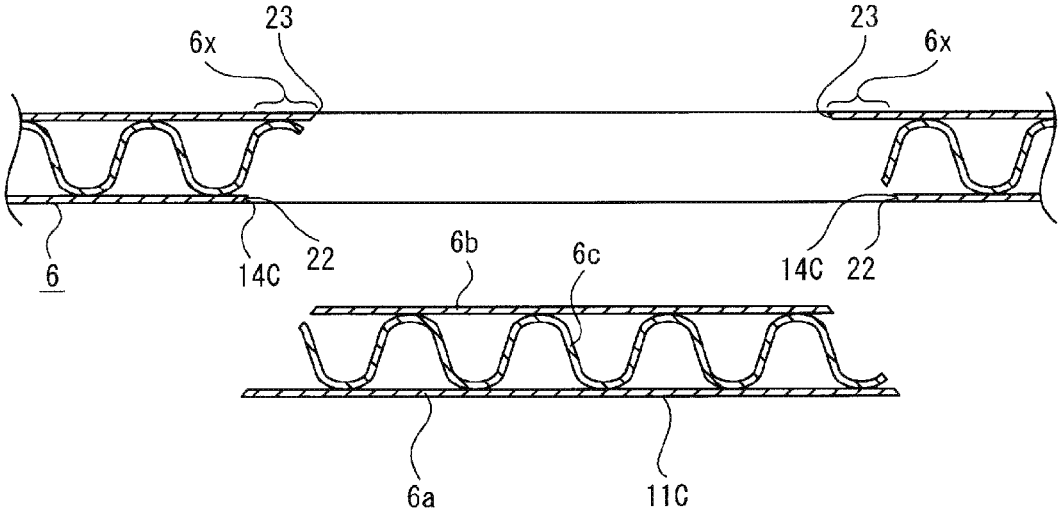
FIG. 20 is an enlarged sectional view conceptually showing a state in which a pull tab portion has been drawn out in the third modification.

Now, a pull tab portion 11C according to a third modification will be described below (see FIGS. 19 and 20). FIG. 19 illustrates a state before the pull tab portion 11C is drawn out, and FIG. 20 illustrates conceptually a state after the pull tab portion 11C is drawn out.

The pull tab portion 11C has second incisions 14C and 14C formed in the form of broken lines which penetrate the first side surface portion 6, wherein cuts 22, 22, . . . formed in the face liner 6*a* are located on outer sides in the left-right direction than cuts 23, 23, . . . formed in the back liner 6*b*. Therefore, the distance between the second incisions 14C and 14C in the face liner 6*a* of the pull tab portion 11C is set greater than the distance between the second incisions 14C and 14C in the back liner 6*b*.

The cuts 22, 22, . . . and the cuts 23, 23, . . . are formed in the state of having their cutting planes inclined relative to the left-right direction. Note that alternate long and short dash lines in FIG. 19 are imaginary lines for indicating the cutting directions of the cuts 22, 22, . . . and the cuts 23, 23, . . . .

The cuts 22, 22, . . . and the cuts 23, 23, . . . are inclined such as to be displaced in the left-right direction in going in the front-rear direction.

Note that the second incisions 14C and 14C may be formed in the form of solid lines.

As above-mentioned, the pull tab portion 11C has a configuration wherein the distance between the second incisions 14C and 14C in the face liner 6*a* is set greater than the distance between the second incisions 14C and 14C in the back liner 6*b*. Therefore, parts 6*x* and 6*x* relevant to the difference between the distance on the face liner 6*a* side in the left-right direction of the pull tab portion 11C and the distance on the back liner 6*b* side act as endurance (resistance) against forces which may be exerted on the pull tab portion 11C from outside.

Therefore, the pull tab portion 11C becomes harder to push in and easier to draw out. Accordingly, unintentional pushing-in of the pull tab portion 11C during transportation or the like is not liable to occur, and the pull tab portion 11C can be drawn out easily.

In the case where the second incisions 14C and 14C are formed in the form of broken lines, the second incisions 14C and 14C can be formed by use of the comb-tooth-shaped incision forming apparatus 50 shown in the second modification. With the second incisions 14C and 14C formed by use of the incision forming apparatus 50, the corrugated fiberboard box 1 can be manufactured with enhanced mass productivity through a facilitated production process and a shortened production time.

In addition, in the case where the second incisions 14C and 14C are formed by use of the incision forming apparatus 50, the cuts 22, 22, . . . formed in the face liner 6*a* are shorter in length than the cuts 23, 23, . . . formed in the back liner 6*b*. Therefore, the pull tab portion 11C becomes harder to push in and easier to draw out. Accordingly, unintentional pushing-in of the pull tab portion 11C during transportation or the like is less liable to occur, and the pull tab portion 11C can be drawn out more easily.

Figure 21:
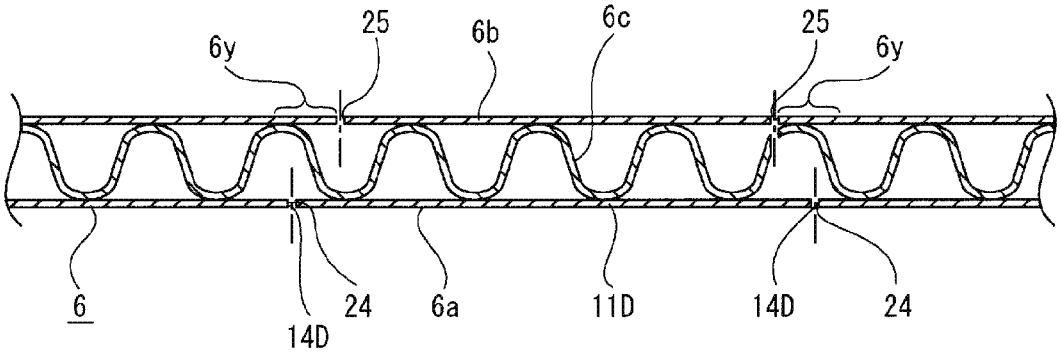
FIG. 21 is an enlarged sectional view showing a fourth modification.
Figure 22:
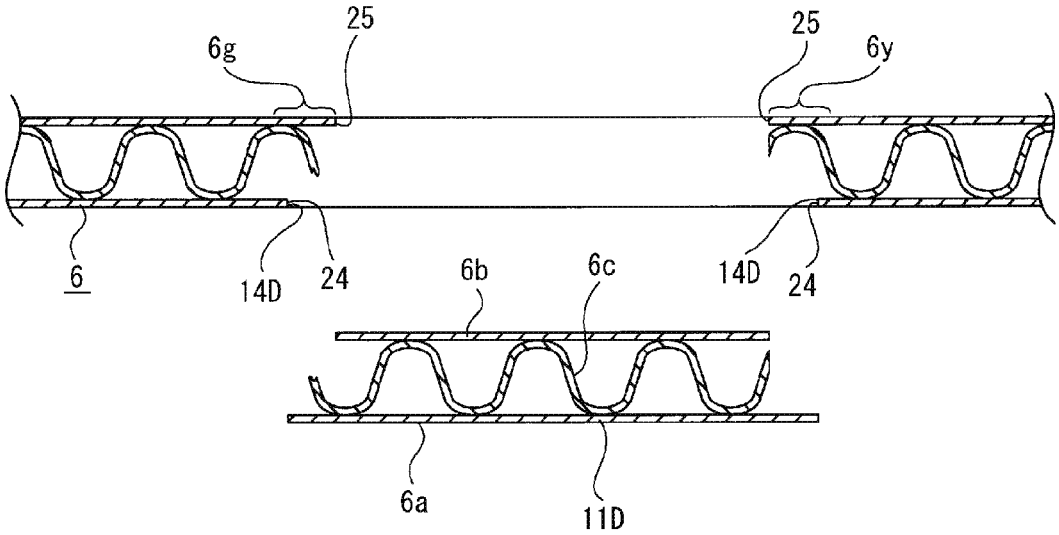
FIG. 22 is an enlarged sectional view conceptually showing a state in which a pull tab portion has been drawn out in the fourth modification.

Now, a pull tab portion 11D according to a fourth modification will be described below (see FIGS. 21 and 22). FIG. 21 illustrates a state before the pull tab portion 11D is drawn out, and FIG. 22 illustrates conceptually a state after the pull tab portion 11D is drawn out.

The pull tab portion 11D has second incisions 14D and 14D which are formed in the form of broken lines, wherein cuts 24, 24, . . . are formed in the face liner 6*a* or in both the face liner 6*a* and the core 6*c*, whereas cuts 25, 25, . . . are formed in the back liner 6*b* or in both the back liner 6*b* and the core 6*c*.

The pull tab portion 11D has a configuration in which the cuts 24, 24, . . . formed on the face liner 6*a* side are located on outer sides in the left-right direction than the cuts 25, 25, . . . formed on the back liner 6*b* side. Therefore, in the pull tab portion 11D, the distance between the second incisions 14D and 14D in the face liner 6*a* is set greater than the distance between the second incisions 14D and 14D in the back liner 6*b*.

The cuts 24, 24, . . . and the cuts 25, 25, . . . are formed in the state of having their cutting planes oriented in the left-right directions. Note that alternate long and short dash lines in FIG. 21 are imaginary lines for indicating the cutting directions of the cuts 24, 24, . . . , and the cuts 25, 25, . . . .

Note that the second incisions 14D and 14D may be formed in the form of solid lines.

Since the pull tab portion 11D thus has a configuration wherein the distance between the second incisions 14D and 14D in the face liner 6*a* is set greater than the distance between the second incisions 14D and 14D in the back liner 6*b*, parts 6*y* and 6*y* relevant to the difference between the distance on the face liner 6*a* side in the left-right direction of the pull tab portion 11D and the distance on the back liner 6*b* side act as endurance (resistance) against forces which may be exerted on the pull tab portion 11D from outside.

Therefore, the pull tab portion 11D becomes harder to push in and easier to draw out. Accordingly, unintentional pushing-in of the pull tab portion 11D during transportation or the like is not liable to occur, and the pull tab portion 11D can be drawn out easily.

Now, a pull tab portion 11E and a push-in portion 12E according to a fifth modification will be described below (see FIGS. 23 and 24).

Figure 23:
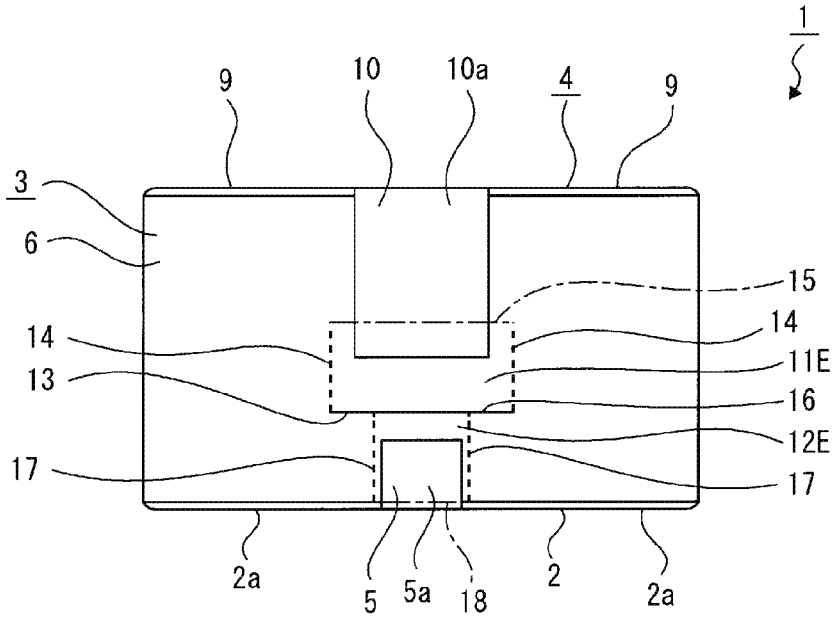
FIG. 23 is a front view showing a fifth modification.
Figure 24:
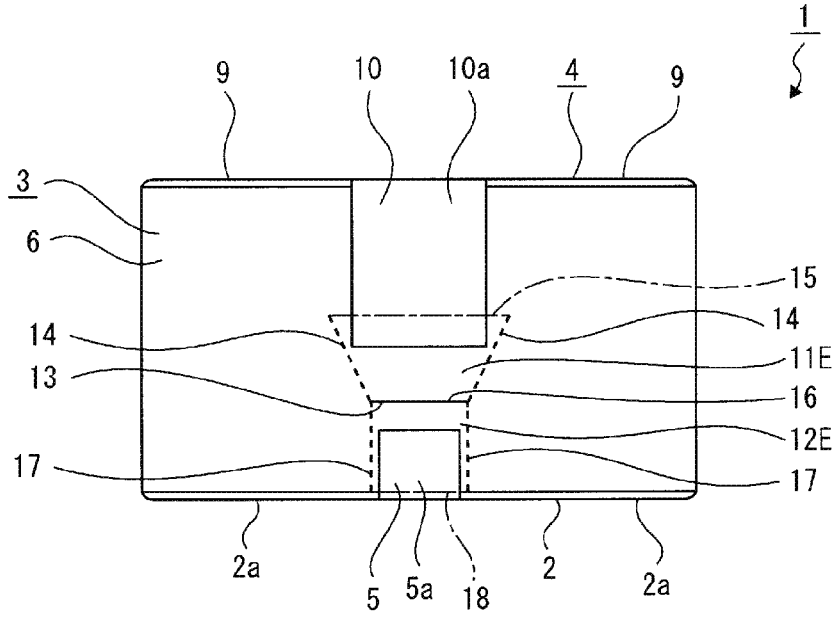
FIG. 24 is a front view showing an example in which a pull tab portion is formed in an isosceles trapezoidal shape in the fifth modification.

The pull tab portion 11E and the push-in portion 12E are each formed in a rectangular shape, wherein the width of the push-in portion 12E in the left-right direction is set smaller than the width of the pull tab portion 11E in the left-right direction, and the area of the push-in portion 12E is set smaller than the area of the pull tab portion 11E (see FIG. 23).

Since the area of the push-in portion 12E is thus set smaller than the area of the pull tab portion 11E, the push-in portion 12E is harder to push in than the pull tab portion 11E. Therefore, unintentional pushing-in of the push-in portion 12E during transportation or the like is less liable to occur, and a favorable state of transport can be secured. Particularly, since the push-in portion is liable to be structured such that it can be easily pushed in with a small force, setting the area of the push-in portion 12E smaller than the area of the pull tab portion 11E to thereby make it harder to push in the push-in portion 12E is effective means for securing a favorable state of transport.

Note that in the fifth modification, the shapes of the pull tab portion 11E and the push-in portion 12E are not each limited to a rectangular shape. For example, as shown in FIG. 24, the pull tab portion 11E may be formed in an isosceles trapezoidal shape, and the area of the push-in portion 12E can thereby be set smaller than the area of the pull tab portion 11E.

Figure 25:
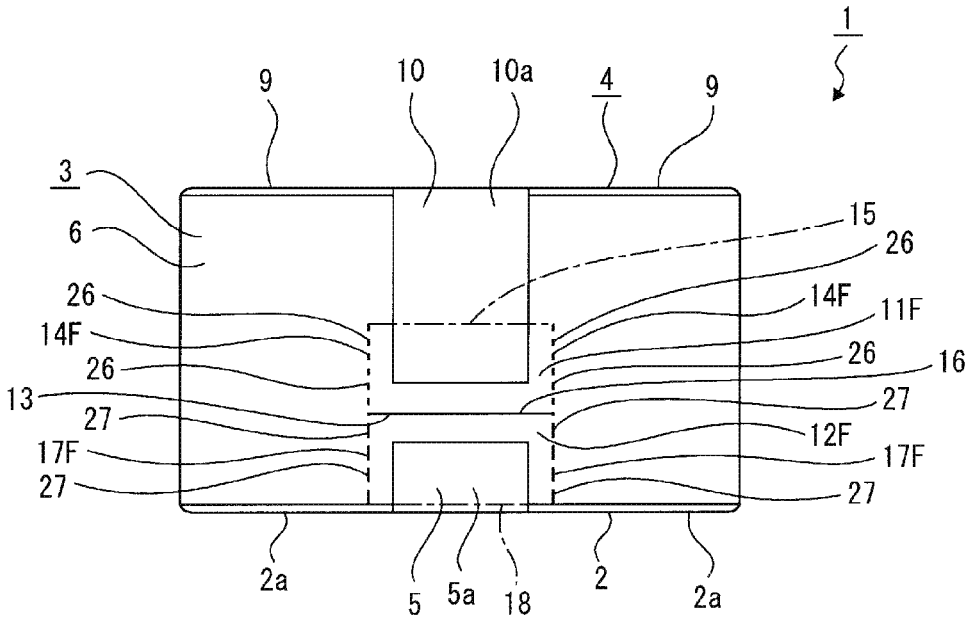
FIG. 25 is a front view showing a sixth modification.

Now, a pull tab portion 11F and a push-in portion 12F according to a sixth modification will be described below (see FIG. 25).

The pull tab portion 11F and the push-in portion 12F have second incisions 14F and 14F and fifth incisions 17F and 17F which are each formed in the form of a broken line. Cuts 26, 26, . . . in the second incisions 14F and 14F are set shorter in length than cuts 27, 27, . . . in the fifth incisions 17F and 17F. Note that in the case where at least one of the cut 26 and the cut 27 is formed as a cut penetrating from the face liner 6*a* to the back liner 6*c* and where the cut in the face liner 6*a* and the cut in the back liner 6*c* are different from each other in length, the longest one of the cuts 26 is set shorter in length than the longest one of the cuts 27.

Therefore, the pull tab portion 11F is made harder to push in whereas the push-in portion 12F is made easier to push in. For this reason, unintentional pushing-in of the pull tab portion 11F during transportation or the like is less liable to occur, so that a favorable state of transport can be secured. In addition, the push-in portion 12F can be easily pushed in during package opening through the adhesive tape 10, so that enhanced workability in the package opening can be realized.

Other Examples

Now, other examples of the pull tab portion or push-in portion or portions related thereto will be described below (see FIGS. 26 to 30).

Note that since the other examples shown below are different from the above-described pull tab portion 11 or push-in portion 12 only in the configuration of a part or parts or due to the addition of the configuration of a part or parts, only the part or parts different as compared with the pull tab portion 11 or push-in portion 12 will be described in detail, the other parts will be denoted by the same reference symbols as used for the equivalent parts in the pull tab portion 11 or push-in portion 12, and descriptions thereof will be omitted.

Figure 26:
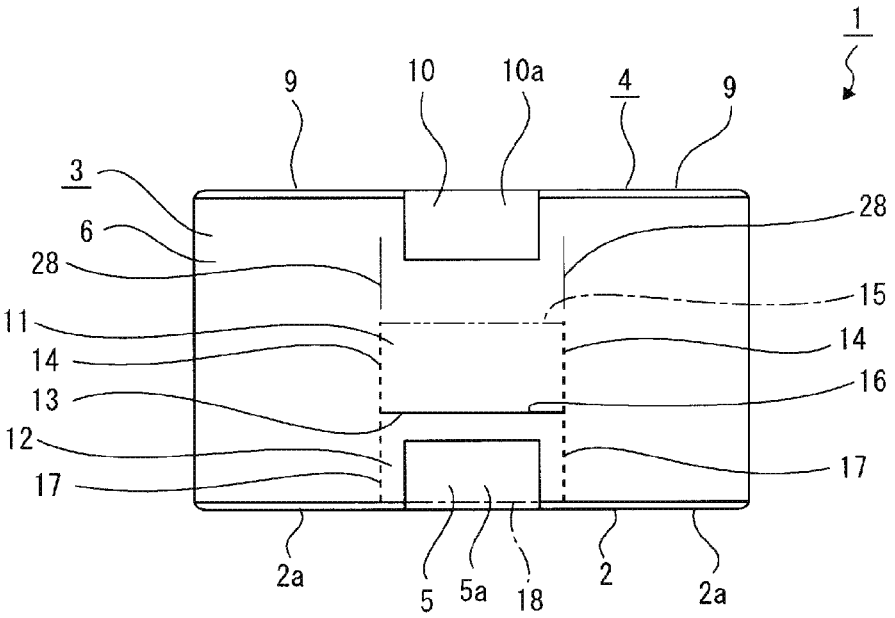
FIG. 26 is a front view showing an example in which vertically extending auxiliary incisions have been formed.
Figure 27:
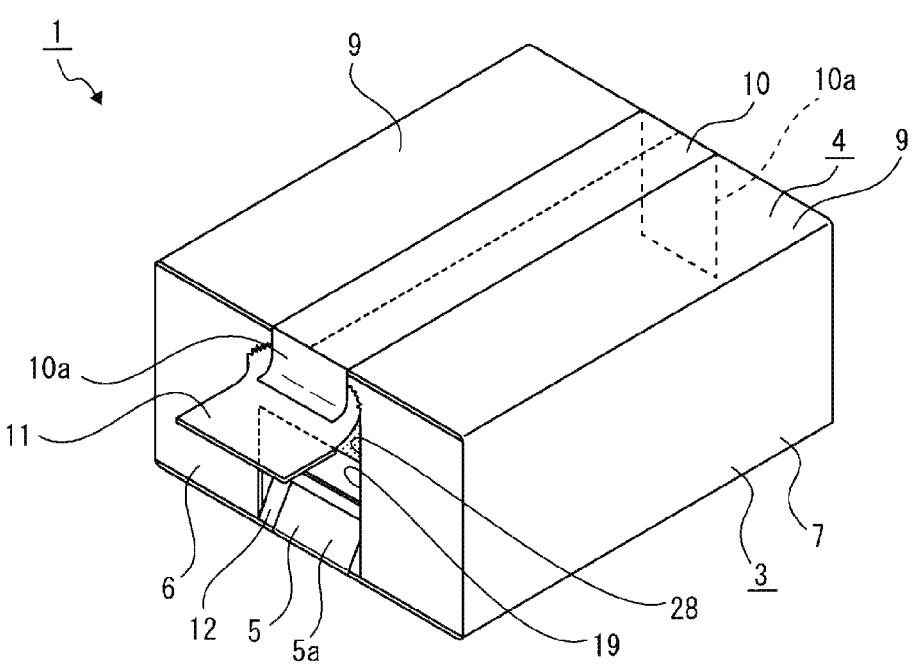
FIG. 27 is a perspective view showing a state in which as a face liner is gradually peeled by pulling a pull tab portion, left and right ruptured parts of the face liner are guided by the auxiliary incisions, and that part of the face liner which is located between the auxiliary incisions is peeled.

A first example is an example in which auxiliary incisions 28 and 28 are each formed on the upper side of the second incisions 14 and 14 in the first side surface portion 6 (see FIG. 26).

The auxiliary incisions 28 and 28 are formed in the form of vertically extending solid lines, and their lower ends are located in coincide with or in the vicinity of the respective upper ends of the second incisions 14 and 14. The auxiliary incisions 28 and 28 have their upper ends each located on outer sides in the left-right direction than both left and right side edges of the adhesive tape 10.

The auxiliary incisions 28 and 28 are formed in the whole part in the thickness direction of the face liner 6*a* or in only a surface portion of the face liner 6*a*.

In the case where the auxiliary incisions 28 and 28 are formed, the configuration is especially effective in a state in which the end portion 10*a* of the adhesive tape 10 is stuck at a position on the upper side of the pull tab portion 11. Specifically, as the face liner 6*a* is gradually peeled off by pulling the pull tab portion 11, left and right ruptured parts of the face liner 6*a* are guided by the auxiliary incisions 28 and 28, and that part of the face liner 6*a* which is located between the auxiliary incisions 28 and 28 is gradually peeled off (see FIG. 27). When the face liner 6*a* is peeled off to the upper ends of the auxiliary incisions 28 and 28, a tip part of the end portion 10*a* of the adhesive tape 10 has been peeled off together with the face liner 6*a*. Then, both left and right side edges of the face liner 6*a*, which are gradually decreased in width as they are peeled off by further pulling the pull tab portion 11, do not reach the lower edge of the end portion 10*a* but reach both left and right side edges of the end portion 10*a*, respectively.

Therefore, by further pulling the pull tab portion 11 along the adhesive tape 10, it is possible to peel the adhesive tape 10 together with the face liner 6*a*.

In the corrugated fiberboard box 1 formed with the auxiliary incisions 28 and 28 in this manner, even in the case where the end portion 10*a* is not stuck to the pull tab portion 11, the adhesion of the adhesive tape 10 is not liable to act as a resistance against the force exerted for peeling the adhesive tape 10, so that the adhesive tape 10 can be easily peeled regardless of the position where the adhesive tape 10 is stuck.

In addition, the auxiliary incisions 28 and 28 are formed in the whole part in the thickness direction of the face liner 6*a* or in only a surface portion of the face liner 6*a*, and are not incisions that penetrate the first side surface portion 6. Therefore, the formation of the auxiliary incisions 28 and 28 does not cause a considerable lowering in the strength of the first side surface portion 6. Thus, the formation of the auxiliary incisions 28 and 28 enables easy peeling of the adhesive tape 10 while securing a sufficient strength of the corrugated fiberboard box 1.

Figure 28:
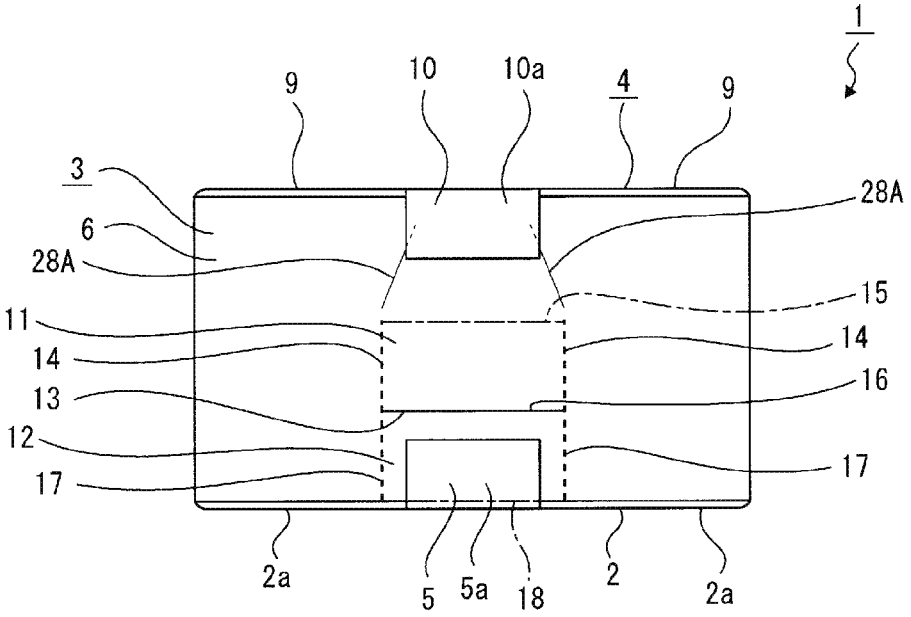
FIG. 28 is a front view showing an example in which inclined auxiliary incisions have been formed.

On the other hand, as the first example, inclined auxiliary incisions 28A and 28A may also be formed in place of the auxiliary incisions 28 and 28 (see FIG. 28).

The auxiliary incisions 28A and 28A are inclined such as to approach each other in going upward, and their lower ends are located in coincidence with or in the vicinity of the respective upper ends of the second incisions 14 and 14. The auxiliary incisions 28A and 28A have their upper ends coinciding with, or located on inner sides in the left-right direction of, respective both left and right side edges of the adhesive tape 10.

The auxiliary incisions 28A and 28A are formed in the whole part in the thickness direction of the face liner 6*a* or in only a surface portion of the face liner 6*a*.

In the case where the auxiliary incisions 28A and 28A are formed, also, the configuration is particularly effective in a state in which the end portion 10*a* of the adhesive tape 10 is stuck at a position on the upper side of the pull tab portion 11. Specifically, as the face liner 6*a* is gradually peeled off by pulling the pull tab portion 11, left and right ruptured parts of the face liner 6*a* are guided by the auxiliary incisions 28A and 28A, and that part of the face liner 6*a* which is located between the auxiliary incisions 28A and 28A is gradually peeled off. When the part between the auxiliary incisions 28A and 28A is peeled off, the left and right ruptured parts of the face liner 6*a* are guided by the auxiliary incisions 28A and 28A, so that both left and right side edges of the face liner 6*a* reach both left and right side edges of the end portion 10*a*, respectively. In this instance, a tip part of the end portion 10*a* of the adhesive tape 10 has already been peeled off together with the face liner 6*a*, so that with the pull tab portion 11 pulled further, the adhesive tape 10 can be peeled together with the face liner 6*a*.

In the corrugated fiberboard box 1 thus formed with the auxiliary incisions 28A and 28A, even in the case where the end portion 10*a* is not stuck to the pull tab portion 11, the adhesion of the adhesive tape 10 is not liable to act as a resistance against the force exerted for peeling the adhesive tape 10, so that the adhesive tape 10 can be easily peeled regardless of the position where the adhesive tape 10 is stuck.

In addition, since the left and right ruptured parts of the face liner 6*a* are guided by the inclined auxiliary incisions 28A and 28A and both the left and right side edges of the face liner 6*a* respectively reach both the left and right side edges of the end portion 10*a*, the adhesive tape 10 can be reliably peeled regardless of the position where the adhesive tape 10 is stuck.

Further, since the auxiliary incisions 28A and 28A are formed in the whole part in the thickness direction of the face liner 6*a* or in only a surface portion of the face liner 6*a* and are not incisions that penetrate the first side surface portion 6, the formation of the auxiliary incisions 28A and 28A does not cause a considerable lowering in the strength of the first side surface portion 6, and the formation of the auxiliary incisions 28A and 28A enables easy peeling of the adhesive tape 10 while securing a sufficient strength of the corrugated fiberboard box 1.

Figure 29:
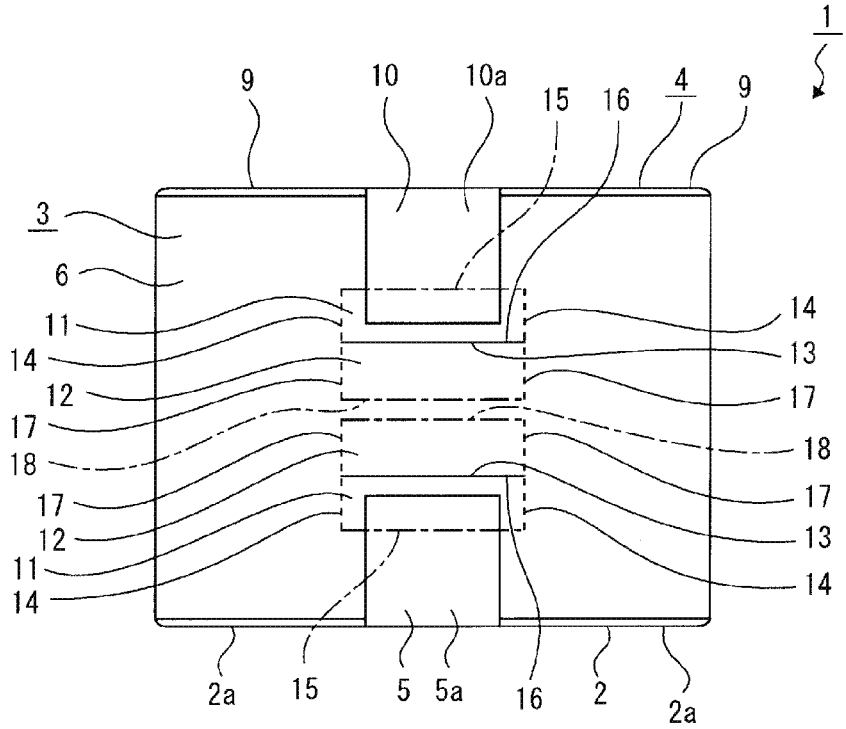
FIG. 29 is a front view showing an example in which pull tab portions and push-in portions have been formed for peeling both an adhesive tape and a sticking tape individually.

A second example is an example in which the first side surface portion 6 is formed with pull tab portions 11 and 11 and push-in portions 12 and 12 for peeling of each of the adhesive tape 10 and the sticking tape 5 (see FIG. 29).

The first side surface portion 6 is formed with the pull tab portion 11 and the push-in portion 12 on an upper side, and is formed with the pull tab portion 11 and the push-in portion 12 on a lower side, too. The pull tab portion 11 and the push-in portion 12 located on the upper side are for peeling of the adhesive tape 10, whereas the pull tab portion 11 and the push-in portion 12 located on the lower side are for peeling of the sticking tape 5. Note that the pull tab portion 11 and the push-in portion 12 located on the lower side are formed in a state in which the push-in portion 12 and the pull tab portion 11 are provided continuously on the upper and lower sides in this order.

In the corrugated fiberboard box 1, with the adhesive tape 10 peeled by use of the pull tab portion 11 and the push-in portion 12 located on the upper side and with the sticking tape 5 peeled by use of the push-in portion 12 and the pull tab portion 11 located on the lower side, peeling operations for the adhesive tape 10 and the sticking tape 5 can both be carried out easily. This is convenient at the time of, for example, folding or discarding the corrugated fiberboard box 1.

Figure 30:
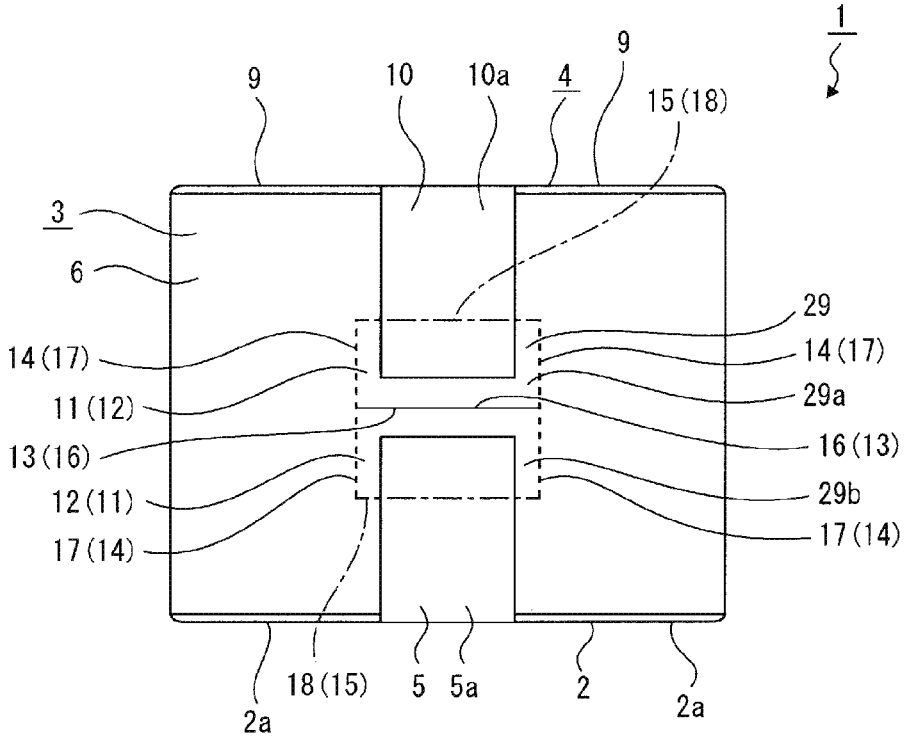
FIG. 30 is a front view showing an example in which a combined-use part for peeling both an adhesive tape and a sticking tape has been formed.

In addition, as the second example, for peeling each of the adhesive tape 10 and the sticking tape 5, the first side surface portion 6 may also be formed with a combined-use portion 29 consisting of a single pull tab portion 11 and a single push-in portion 12 (see FIG. 30).

The combined-use portion 29 consists of a first portion 29*a* and a second portion 29*b* which are formed continuously on the upper and lower sides, wherein one of the first portion 29*a* and the second portion 29*b* functions as the pull tab portion 11 whereas the other functions as the push-in portion 12. At the time of peeling the adhesive tape 10, the first portion 29*a* located on the upper side functions as the pull tab portion 11 whereas the second portion 29*b* located on the lower side functions as the push-in portion 12. At the time of peeling the sticking tape 5, the first portion 29*a* located on the upper side functions as the push-in portion 12 whereas the second portion 29*b* located on the lower side functions as the pull tab portion 11.

Therefore, at the time of peeling the adhesive tape 10, first, the second portion 29*b* functioning as the push-in portion 12 is pushed in. Next, the first portion 29*a* functioning as the pull tab portion 11 is drawn out, and the thus drawn-out 29*a* is pulled along the adhesive tape 10, thereby peeling the adhesive tape 10 together with the face liner 6*a*. On the other hand, at the time of peeling the sticking tape 5, first, the first portion 29*a* functioning as the push-in portion 12 is pushed in. Next, the second portion 29*b* functioning as the pull tab portion 11 is drawn out, and the thus drawn-out 29*a* is pulled along the sticking tape 5, thereby peeling the sticking tape 5 together with the face liner 6*a*.

In the case where the combined-use portion 29 is formed in the above-mentioned manner, with the adhesive tape 10 and the sticking tape 5 peeled by use of the first portion 29*a* located on the upper side and the second portion 29*b* located on the lower side, peeling operations for the adhesive tape 10 and the sticking tape 5 can each be carried out easily. This is convenient at the time of, for example, folding or discarding the corrugated fiberboard box 1.

Besides, in the case where the combined-use portion 29 is formed, the part functioning as the pull tab portion 11 and the part functioning as the push-in portion 12 are each single, and, therefore, that much higher strength of the first side surface portion 6 can be secured, and that much higher strength of the corrugated fiberboard box 1 as a whole can be secured.

<Others>

While examples in which the first to sixth incisions are all formed in the shape of straight lines have been shown in the above description, the first to sixth incisions are not limited to the shape of straight lines; thus, the first to sixth incisions may be formed in the shape of curved lines, or may be formed in the shape of a combination of straight and curved lines, as required.

In addition, the first to sixth incisions may be inclined in relation to the left-right direction or the vertical direction, as required.

Further, of the first to sixth incisions, those which are continuous with each other may be formed as a single line obtained by combining straight and curved lines or combining curved lines, provided that the single line does not have an angular portion. For example, a first incision in the shape of a straight line and a second incision in the shape of a curved line may be formed as a single line such that an incision on one side of a predetermined intermediate point functions as a first incision whereas an incision on the other side functions as a second incision.

REFERENCE SIGNS LIST

1 Corrugated fiberboard box
5 Sticking tape
6 First side surface portion
6*a* Face liner
6*c* Back liner
7 Second side surface portion
8 Inner lap portion
9 Outer lap portion
10 Adhesive tape
11 Pull tab portion
12 Push-in portion
13 First incision
14 Second incision
14*a* Tape-side incision end
15 Third incision
11A Pull tab portion
14A Second incision
11B Pull tab portion
20 Cut
21 Cut
15B Third incision
11C Pull tab portion
14C Second incision
22 Cut
23 Cut
11D Pull tab portion
14D Second incision
24 Cut
25 Cut
11E Pull tab portion
12E Push-in portion
11F Pull tab portion
12F Push-in portion
14F Second incision

26 Cut
27 Cut
28 Auxiliary incision
28A Auxiliary incision

What is claimed is:

1. A corrugated fiberboard box sealed by an adhesive tape, comprising:

a pair of first side surface portions; and a pair of second side surface portions alternately continuous with the pair of first side surface portions, wherein the adhesive tape is stuck to an area ranging from a portion other than the pair of first and second side surface portions to at least one of the pair of first side surface portions on at least one side;

the at least one of the pair of first side surface portions to which the adhesive tape is to be stuck is provided with a push-in portion which is pushed inward during package opening, and a pull tab portion which is located on the adhesive tape side of the push-in portion and is drawn outward during package opening, the push-in portion and the pull tab portion being continuous with each other;

the pull tab portion is formed as an area surrounded by at least three incisions, the at least three incisions being solid or broken line-formed incisions;

the at least three incisions of the pull tab portion include a first incision formed as a boundary line of the push-in portion, and a pair of second incisions each of which is continuous with the first incision and which are located apart from each other;

respective ends of the pair of second incisions which are each located opposite to the push-in portion are called tape-side incision ends, a distance between the respective ends in a width direction of the adhesive tape is set greater than a width of the adhesive tape;

a third incision is formed which is continuous with the two tape-side incision ends;

the third incision includes a cut formed on a back liner of the at least one of the pair of first side surface portions to which the adhesive tape is to be stuck, and does not include a cut on a face liner of the at least one of the pair of first side surface portions to which the adhesive tape is to be stuck; and the push-in portion comprises a folding line that coincides with an end edge of the at least one of the pair of first side surface portions to which the adhesive tape is to be stuck, the folding line configured to fold when the push-in portion is pushed inward, and the folding line does not include an incision.

2. The corrugated fiberboard box according to claim 1, wherein the at least one of the pair of first side surface portions to which the adhesive tape is to be stuck is formed with a pair of auxiliary incisions at positions on an opposite side of the pull tab portion from the push-in portion, each auxiliary incision of the pair of auxiliary incisions has a cut formed only on the face liner of the at least one of the pair of first side surface portions to which the adhesive tape is to be stuck, the pair of auxiliary incisions are located apart from each other in the width direction of the adhesive tape, and a distance between ends of the auxiliary incisions on the pull tab portion side is set greater than the width of the adhesive tape.

3. The corrugated fiberboard box according to claim 2, wherein the distance between the pair of auxiliary incisions is decreased in going away from the pull tab portion.

4. The corrugated fiberboard box according to claim 2, wherein the ends of the pair of auxiliary incisions on the pull tab portion side are located in the vicinity of the respective tape-side incision ends of the pair of seconds incisions.

5. The corrugated fiberboard box according to claim 2, wherein upper ends of the pair of auxiliary incisions are located on inner sides in the left-right direction of respective left and right side edges of the adhesive tape.

6. The corrugated fiberboard box according to claim 1, wherein the pair of second incisions is formed in a form of a broken line having a plurality of cuts in each of the face liner and the back liner, and a length of the cut in the face liner of the pair of second incisions is set shorter than a length of the cut in the back liner of the pair of second incisions.

7. The corrugated fiberboard box according to claim 1, wherein the pair of second incisions is formed by a comb-tooth-shaped incision forming apparatus having a plurality of cutting teeth which penetrate the at least one of the pair of first side surface portions to which the adhesive tape is to be stuck from the back liner side to the face liner side.

8. The corrugated fiberboard box according to claim 1, wherein the pair of second incisions are each formed in a state of having a cut in each of the face liner and the back liner, and a distance between the pair of second incisions in the face liner is set greater than a distance between the pair of second incisions in the back liner.

9. The corrugated fiberboard box according to claim 1, wherein the push-in portion is formed in a tetragonal shape, and the folding line is an end edge of the push-in portion which is opposite to the pull tab portion and is set to coincide with the end edge of the at least one of the pair of first side surface portions to which the adhesive tape is to be stuck.

10. The corrugated fiberboard box according to claim 1, wherein each of the pull tab portion and the push-in portion is formed in a tetragonal shape, the push-in portion is formed as an area surrounded by at least three solid or broken line-formed incisions, the at least three incisions of the push-in portion include a fourth incision formed as a boundary line of the pull tab portion, and a pair of fifth incisions each of which is continuous with the fourth incision and which are spaced apart from each other in ft the width direction of the adhesive tape, each of the pair of second incisions and the pair of fifth incisions are formed in a form of a broken line having a plurality of cuts, and a length of each cut of the pair of second incisions is set shorter than a length of each cut of the pair of fifth incisions.

11. The corrugated fiberboard box according to claim 1, wherein the at least one of the pair of first side surface portions to which the adhesive tape is to be stuck is formed with a pair of auxiliary incisions at positions on an opposite side of the pull tab portion from the push-in portion, such that the pair of auxiliary incisions are on an opposite side of the third incision from the pair of second incisions, each auxiliary incision of the pair of auxiliary incisions has a cut formed only on the face liner of the at least one of the pair of first side surface portions to which the adhesive tape is to be stuck, the pair of auxiliary incisions are located apart from each other in the width direction of the adhesive tape, and a distance between ends of the auxiliary incisions on the pull tab portion side is set greater than the width of the adhesive tape, and the cut of the third incision formed on the back liner of the at least one of the pair of first side surface portions to which the adhesive tape is to be stuck is also formed on a core of the at least one of the pair of first side surface portions to which the adhesive tape is to be stuck.

12. The corrugated fiberboard box according to claim 11, wherein the pair of auxiliary incisions are formed entirely within the at least one of the pair of first side surface portions to which the adhesive tape is to be stuck.

13. The corrugated fiberboard box according to claim 1, wherein each incision in the pair of second incisions includes a cut formed through the face liner, a core, and the back liner of the at least one of the pair of first side surface portions to which the adhesive tape is to be stuck.

14. The corrugated fiberboard box according to claim 1, wherein the third incision does not include a cut on a core of the at least one of the pair of first side surface portions to which the adhesive tape is to be stuck.

15. A corrugated fiberboard box sealed by an adhesive tape, comprising:

a pair of first side surface portions; and a pair of second side surface portions alternately continuous with the pair of first side surface portions, wherein the adhesive tape is stuck to an area ranging from a portion other than the pair of first and second side surface portions to at least one of the pair of first side surface portions on at least one side;

the at least one of the pair of first side surface portions to which the adhesive tape is to be stuck is provided with a push-in portion which is pushed inward during package opening, and a pull tab portion which is located on the adhesive tape side of the push-in portion and is drawn outward during package opening, the push-in portion and the pull tab portion being continuous with each other;

the pull tab portion is formed as an area surrounded by at least three incisions, the at least three incisions being solid or broken line-formed incisions;

the at least three incisions of the pull tab portion include a first incision formed as a boundary line of the push-in portion, and a pair of second incisions each of which is continuous with the first incision and which are located apart from each other;

respective ends of the pair of second incisions which are each located opposite to the push-in portion are called tape-side incision ends, a distance between the respective ends in a width direction of the adhesive tape is set greater than a width of the adhesive tape;

a third incision is formed which is continuous with the two tape-side incision ends;

the third incision includes a cut formed on a back liner of the at least one of the pair of first side surface portions to which the adhesive tape is to be stuck, and does not include a cut on a face liner of the at least one of the pair of first side surface portions to which the adhesive tape is to be stuck;

the push-in portion is formed as an area surrounded by at least three solid or broken line formed incisions;

the at least three incisions of the push-in portion include a fourth incision formed as a boundary line of the pull tab portion, and a pair of fifth incisions each of which is continuous with the fourth incision and which are spaced apart from each other in the width direction of the adhesive tape;

the adhesive tape is stuck to at least the push-in portion of the at least one of the pair of first side surface portions to which the adhesive tape is to be stuck, each of the pair of second incisions and each of the pair of fifth incisions are continuous with each other; and the pair of second incisions and the pair of fifth incisions are formed in a state of being parallel to side edges of the adhesive tape on both sides in the width direction of the adhesive tape, and the push-in portion comprises a folding line that coincides with a push-in-portion-side end edge of the at least one of the pair of first side surface portions to which the adhesive tape is to be stuck, the folding line configured to fold when the push-in portion is pushed inward, and the folding line does not include an incision.

16. The corrugated fiberboard box according to claim 15, wherein the tape-side incision ends of the pair of second incisions are located between the first incision and a pull-tab-side end edge of the at least one of the pair of first side surface portions to which the adhesive tape is to be stuck, and respective ends of the pair of fifth incisions, which are each located opposite to the pull tab portion, are located between the forth incision and the push-in-portion-side end edge of the at least one of the pair of first side surface portions to which the adhesive tape is to be stuck.

17. A corrugated fiberboard box sealed by an adhesive tape, comprising:

a pair of first side surface portions; and a pair of second side surface portions alternately continuous with the pair of first side surface portions, wherein the adhesive tape is stuck to an area ranging from a portion other than the pair of first and second side surface portions to at least one of the pair of first side surface portions on at least one side;

the at least one of the pair of first side surface portions to which the adhesive tape is to be stuck is provided with a push-in portion which is pushed inward during package opening, and a pull tab portion which is located on the adhesive tape side of the push-in portion and is drawn outward during package opening, the push-in portion and the pull tab portion being continuous with each other;

the pull tab portion is formed as an area surrounded by at least three incisions, the at least three incisions being solid or broken line-formed incisions;

the at least three incisions of the pull tab portion include a first incision formed as a boundary line of the push-in portion, and a pair of second incisions each of which is continuous with the first incision and which are located apart from each other;

respective ends of the pair of second incisions which are each located opposite to the push-in portion are called tape-side incision ends, a distance between the respective ends in a width direction of the adhesive tape is set greater than a width of the adhesive tape;

a third incision is formed which is continuous with the two tape-side incision ends;

the third incision includes a cut formed on a back liner of the at least one of the pair of first side surface portions to which the adhesive tape is to be stuck, and does not include a cut on a face liner of the at least one of the pair of first side surface portions to which the adhesive tape is to be stuck; and the cut of the third incision coincides with an upper edge of the at least one of the pair of first side surface portions to which the adhesive tape is to be stuck.

* * * * *